US010370768B2

(12) United States Patent
Salehi-Khojin et al.

(10) Patent No.: US 10,370,768 B2
(45) Date of Patent: Aug. 6, 2019

(54) CATALYSTS FOR CARBON DIOXIDE CONVERSION

(71) Applicant: The Board of Trustees of the University of Illinois, Urbana, IL (US)

(72) Inventors: Amin Salehi-Khojin, Chicago, IL (US); Mohammad Asadi, Chicago, IL (US); Bijandra Kumar, Chicago, IL (US)

(73) Assignee: The Board of Trustees of the University of Illinois, Urbana, IL (US)

( * ) Notice: Subject to any disclaimer, the term of this patent is extended or adjusted under 35 U.S.C. 154(b) by 409 days.

(21) Appl. No.: 14/392,120

(22) PCT Filed: Jun. 27, 2014

(86) PCT No.: PCT/US2014/044616

§ 371 (c)(1),
(2) Date: Dec. 23, 2015

(87) PCT Pub. No.: WO2014/210484

PCT Pub. Date: Dec. 31, 2014

(65) Prior Publication Data

US 2016/0145752 A1 May 26, 2016

Related U.S. Application Data

(60) Provisional application No. 61/840,167, filed on Jun. 27, 2013.

(51) Int. Cl.
*C25B 1/00* (2006.01)
*C25B 11/04* (2006.01)
(Continued)

(52) U.S. Cl.
CPC ..... *C25B 11/0447* (2013.01); *C25B 1/00* (2013.01); *C25B 1/02* (2013.01); *C25B 3/04* (2013.01)

(58) Field of Classification Search
CPC ..... C25B 11/0447; C25B 3/04; C25B 1/00; C25B 1/02
See application file for complete search history.

(56) References Cited

U.S. PATENT DOCUMENTS 4,414,080 A 11/1983 Williams et al.
2008/0283411 A1 11/2008 Eastman et al.
(Continued)

FOREIGN PATENT DOCUMENTS

WO 2012/006240 1/2012
WO WO 2013/134418 A1 9/2013

OTHER PUBLICATIONS

European Search Report issued in co-pending European Patent Application No. 14818616.7, European Patent Office, dated Dec. 8, 2016, 9 pages.
(Continued)

*Primary Examiner* — Arun S Phasge
(74) *Attorney, Agent, or Firm* — McDonnell Boehnen Hulbert & Berghoff LLP

(57) ABSTRACT

The disclosure relates generally to improved methods for the reduction of carbon dioxide. The disclosure relates more specifically to catalytic methods for electrochemical reduction of carbon dioxide that can be operated at commercially viable voltages and at low overpotentials. The disclosure uses a transition metal dichalcogenide and helper catalyst in contact within the cell.

22 Claims, 15 Drawing Sheets

(51) Int. Cl.
*C25B 1/02* (2006.01)
*C25B 3/04* (2006.01)

(56) References Cited

U.S. PATENT DOCUMENTS

| | | | |
|---|---|---|---|
| 2013/2032965 | | 12/2012 | Eastman et al. |
| 2013/0008800 | A1 | 1/2013 | Lakkaraju et al. |
| 2013/0084474 | A1 | 4/2013 | Mills |
| 2013/0157149 | A1 | 6/2013 | Peled et al. |
| 2013/0157174 | A1 | 6/2013 | Masel et al. |
| 2013/0180865 | A1* | 7/2013 | Cole ..... C25B 3/04 205/441 |

OTHER PUBLICATIONS

Bollinger, M.V. et al., "On-Dimensional Metallic Edge States in MoS2," Physical Review Letters, vol. 87, No. 19, Nov. 5, 2001, 4 pages.
Bonde, Jacob et al., "Hydrogen Evolution on Nano-Paticulate Transition Metal Sulfides," Faraday Discussion, vol. 140, Mar. 28, 2008, 15 pages.
Botello-Mendez, A. R., et al., "Metallic and Ferromagnetic Edges in Molybdenum Disulfide Nanoribbons," Nanotechnology, vol. 20, (2009) 7 pages.
Brook, Edward J., "Leads and Lags at the End of the Last Ice Age," Science, vol. 339, Mar. 1, 2013, 3 pages.
Chen, Yihong et al., "Aqueous CO2 Reduction at Very Low Overpotenital on Oxide-derived Au Nanopaticles," Journal of the American Chemical Society, vol. 134 (2012) 4 pages.
Chhowalla, Manish et al., "The Chemistry of Two-Dimensional Layered Transition Metal Dichalcogenide Nanosheets," Nature Chemistry, vol. 5, Apr. 2013, 13 pages.
Chianelli, Russell R. et al., "Catalytic Properties of Single Layers of Transition Metal Sulfide Catalytic Materials," Catalysis Reviews Science and Engineering, Catalysis Reviews, 48:1-41, 2006, 42 pages.
Davis, Steven J. et al., "Future CO2 Emissions and Climate Change from Existing Energy Infrastructure," Science, vol. 329, Sep. 10, 2010, 5 pages.
Edward, John T., "Molecular Volumes and the Stokes-Einstein Equation," Journal of Chemical Education, vol. 47, No. 4, Apr. 1970, 10 pages.
Freire, Mara G. et al., "Hydrolysis of Tetrafluoroborate and Hexafluorophosphate Counter Ions in Imidazolium-Based Ionic Liquids," J. Phys. Chem., vol. 114 (2010), 6 pages.
Gattrell, M. et al., "A Review of the Aqueous Electrochemical Reduction of CO2 to Hydrocarbons At Copper," Elsevier, Journal of Electroanalytical Chemistry, vol. 594 (2006), 19 pages.
Hinnemann, Berit et al., "Biomimetic Hydrogen Evolution: MoS2 Nanoparticles as Catalyst for Hydrogen Evolution," Journal of American Chemical Society, vol. 127 (2005) 2 pages.
Hoshi, Nagahiro et al., "Electrochemical Reduction of CO2 on Single Crystal Electrodes of Silver Ag(111), Ag(100) and Ag(110)," Elsevier, Journal of Electroanalytical Chemistry, vol. 440 (1997) 4 pages.
Jaramillo, Thomas F. et al., "Identification of Active Edge Sites for Electrochemical H2 Evolution from MoS2 Nanocatalysts," Science, vol. 317, Jul. 6, 2007, 4 pages.
Karunadasa, Hemamal I. et al., "A Molecular MoS2 Edge Site Mimic for Catalytic Hydrogen generation," Science, vol. 335, Feb. 10, 2012, 6 pages.
Kibsgaard, Jakob et al., "Engineering the Surface Structure of MoS2 to Preferentially Expose Active Edge Sites for Electroacatalysis," Nature Materials, vol. 11, Nov. 2012, 7 pages.
Li, Christina W. et al., "CO2 Reduction at Low Overpotential on Cu Electrodes Resulting from the Reduction of Thick Cu2O Films," Journal of the American Chemical Society, vol. 134 (2012) 4 pages.
Li, Yanguang et al., "MoS2 Nanopaticles Grown on Graphene: An Advanced Catalyst for the Hydrogen Evolution Reaction," Journal of the American Chemical Society, vol. 133 (2011), 4 pages.
Lukaszewski, M. et al., "Electrosorption of Carbon Dioxide on Platinum Group Metals and Alloys—A Review," J. Solid State Electrochem vol. 13 (2009) 15 pages.
Mazarei, Abbas F. et al., "Diffusion Coefficients for Helium, Hydrogen, and Carbon Dioxide in Water at 25° C.," AIChE Journal, vol. 26, No. 1, Jan. 1980, 4 pages.
Parrenin, F. et al., "Synchronous Change of Atmospheric CO2 and Antarctic Temperature During the Last Deglacial Warming," Science, vol. 339, Mar. 1, 2013, 5 pages.
Rosen, Brian A. et al., "In Situ Spectroscopic Examination of a Low Overpotential Pathway for Carbon Dioxide Conversion to Carbon Monoxide," The Journal of Physical Chemistry, vol. 116 (2012) 6 pages.
Rosen, Brian A. et al., "Ionic Liquid-Mediated Selective Conversion of CO2 to CO at Low Overpotentials," Sciencexpress, (10.1126) Sep. 29, 2011, 8 pages.
Rosen, Brian A. et al., "Water Enhancement of CO2 Conversion on Silver in 1-Ethyl-3-Methylimidazolium Tetrafluoroborate," Journal of the Electrochemical Society, vol. 160(2), (2013) 4 pages.
Salehi-Khojin, Amin et al., "Nanopaticle Silver Catalysts that Show Enhanced Activity for Carbon Dioxide Electroysis," The Journal of Physical Chemistry, vol. 117 (2013), 6 pages.
Tran, Richard et al., "Data Descriptor: Surface Energies of Elemental Crystals," Scientific Data, Sep. 13, 2016, 13 pages.
Wamser, Christian A., "Hydrolysis of Fluoboric Acid in Aqueous Solution," Contribution from the Laboratory of C. A. Wamser, Mar. 1948, 7 pages.
Wang, Qing Hua et al., "Electronics and Optoelectronics of two-Dimensional Transition Metal Dichalcogenides," Nature Nanotechnology, vol. 7, Nov. 2012, 14 pages.
Whipple, Devin T. et al., "Prospects of CO2 Utilization via Direct Heterogeneous Electrochemical Reduction," The Journal of Physical Chemistry Letters, vol. 1 (2010) 8 pages.

* cited by examiner

CATALYSTS FOR CARBON DIOXIDE CONVERSION

CROSS-REFERENCE TO RELATED APPLICATIONS

This application is U.S. national phase application of International Patent Application no. PCT/US2014/044616 filed on Jun. 27, 2014, which claims the benefit of priority of U.S. Provisional Patent Application Ser. No. 61/840,167, filed Jun. 27, 2013, which is hereby incorporated herein by reference in its entirety.

BACKGROUND OF THE INVENTION

Field of the Invention

The disclosure relates generally to improved methods for the reduction of carbon dioxide. The disclosure relates more specifically to catalytic methods for electrochemical reduction of carbon dioxide that can be operated at commercially viable voltages and at low overpotentials.

Description of Related Art

During the last few decades, the amount of carbon dioxide ($CO_2$) present in the environment has reached the highest level (396.80 ppm) of the last 20 million years, causing radical and largely unpredictable changes in the environment. Recent efforts have revealed that $CO_2$ can be converted by electrochemical reduction processes using renewable energy sources into energy-rich modules (e.g., syngas, methanol), offering an efficient path for both $CO_2$ remediation and an alternative energy source. Numerous physical and chemical approaches have been employed to improve the performance of existing $CO_2$ reduction systems without achieving a major breakthrough.

SUMMARY OF THE INVENTION

Improving the $CO_2$ reduction by electrochemical processes to increase conversion performance and decrease costs still presents a challenge. Recently, transition metal dichalcogenides (TMDCs), including molybdenum disulfide ($MoS_2$), have attracted a significant attention due to their low price and prominent catalytic features. For example, $MoS_2$ has become widely used as an efficient catalyst for hydrodesulphurization, oxygen reduction reactions, hydrogen evolution reaction (HER), and water splitting. In certain aspects, the present disclosure provides improves methods for $CO_2$ reduction by electrochemical processes that operate using of a catalyst comprising at least one transition metal dichalcogenide. In certain aspects, the methods of the disclosure can decrease operating and capital costs while maintaining or improving conversion yields and/or selectivity. Without being bound to a particular theory, it is believed that the significantly higher $CO_2$ reduction current density (relative to noble metal catalysts) can be primarily attributed to a high density of d-electrons in TMDC-terminated edges (such as Mo-terminated edges) and also to its low work function. It can also be attributed to the TMDC atomic configuration/arrangement such as 1T, 2H, defects, etc.

In a broad aspect, the disclosure provides methods of electrochemically reducing carbon dioxide in an electrochemical cell, comprising contacting the carbon dioxide with at least one transition metal dichalcogenide in the electrochemical cell and at least one helper catalyst and applying a potential of about −2 to about +2 V vs. reversible hydrogen electrode to the electrochemical cell.

In another aspect, the disclosure provides methods of electrochemically reducing carbon dioxide comprising: providing an electrochemical cell having a cathode in contact with at least one transition metal dichalcogenide, and an electrolyte comprising at least one helper catalyst in contact with the cathode and the at least one transition metal dichalcogenide; providing carbon dioxide to the electrochemical cell; and applying a voltage potential of about −2 to about +2 V vs. reversible hydrogen electrode to the electrochemical cell.

The disclosure also provides an electrochemical cell having a cathode in contact with at least one transition metal dichalcogenide, and an electrolyte comprising at least one helper catalyst. In some aspects, the electrochemical cells of the disclosure are useful for reducing carbon dioxide.

The disclosure also provides compositions comprising at least one transition metal dichalcogenide in contact with at least one helper catalyst. The disclosure also provides compositions comprising at least one transition metal dichalcogenide in contact with an aqueous solution comprising at least one helper catalyst. In certain aspects, these compositions are useful for reducing carbon dioxide in an electrochemical cell upon applying a voltage potential.

DETAILED DESCRIPTION OF THE INVENTION

Figure 1:
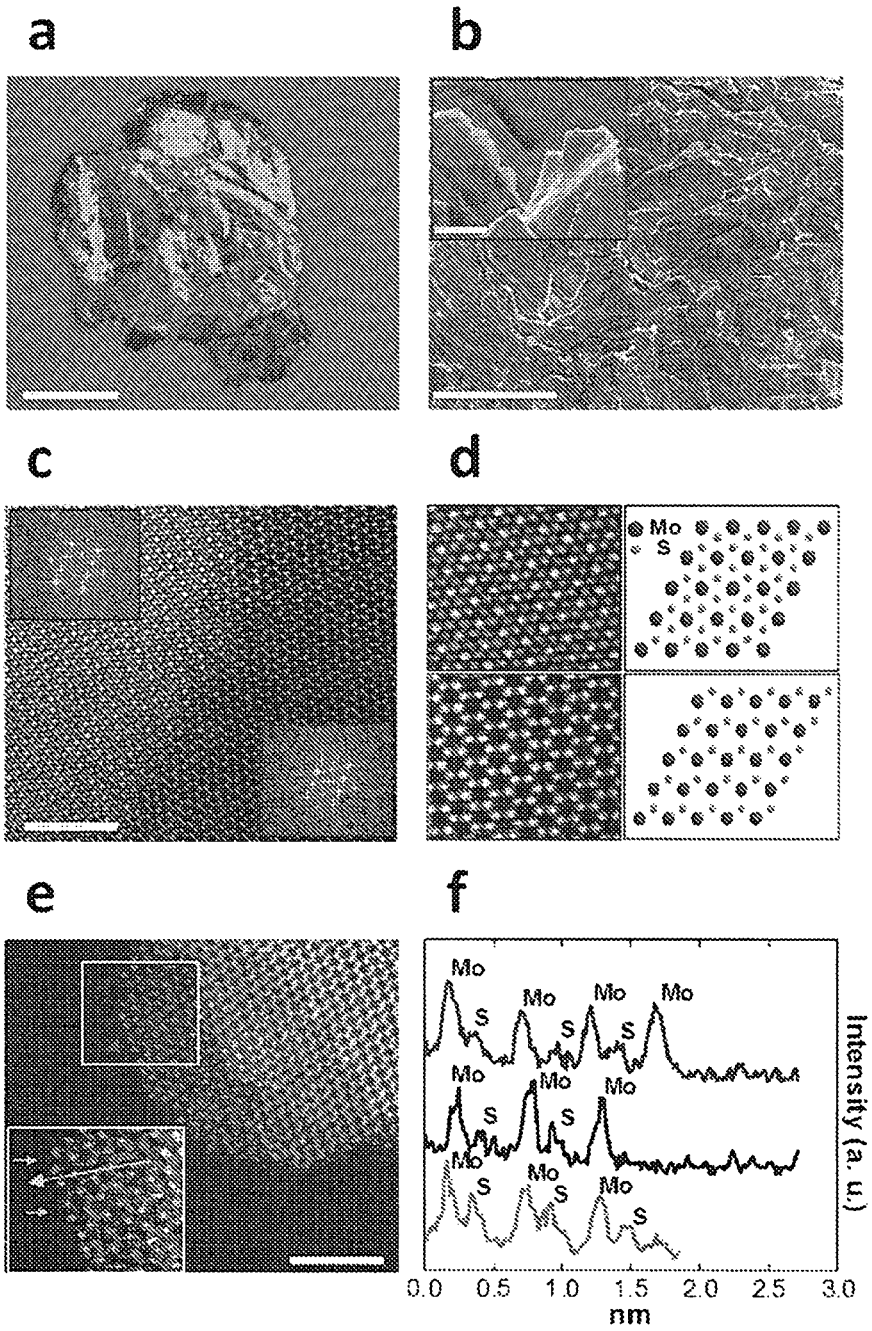
FIG. 1 shows a structural and elemental analysis of $MoS_2$, (a) optical image of bulk $MoS_2$ used as catalyst (scale bar, 2 mm), (b) SEM images of the $MoS_2$ displaying the stacked layered structure and sharp edges of the $MoS_2$ flakes (scale bars are 50 and 5 μm (for inset) respectively), and (c) high-angle annular dark-field (HAADF) images (scale bar, 5 nm) showing both the 1T (blue) and 2H (red) phases of $MoS_2$, along with their respective Fast Fourier Transforms (FFTs) (inset). (d) Higher magnification HAADF images show clearly distinct atomic configuration corresponding to the 1T (top) and 2H (bottom) type of $MoS_2$. The related schematic atomic models have also been shown on the right side. (e) Raw grayscale HAADF and false-color low-angle annular dark-field (LAADF) image (inset) of $MoS_2$ edges (scale bar, 5 nm) and (f) the line scans (red and blue towards edges) identifying Mo atoms to be the terminating atoms in the general case. In limited instances, an additional light atom (gray line scan) is visible, occupying what should be a Mo-position, most probably a carbon atom from the STEM substrate.

Before the disclosed methods and compositions are described, it is to be understood that the aspects described herein are not limited to specific embodiments, apparati, or configurations, and as such can, of course, vary. It is also to be understood that the terminology used herein is for the purpose of describing particular aspects only and, unless specifically defined herein, is not intended to be limiting.

Throughout this specification, unless the context requires otherwise, the word "comprise" and "include" and variations (e.g., "comprises," "comprising," "includes," "including") will be understood to imply the inclusion of a stated component, feature, element, or step or group of components, features, elements or steps but not the exclusion of any other integer or step or group of integers or steps.

As used in the specification and the appended claims, the singular forms "a," "an" and "the" include plural referents unless the context clearly dictates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the term "contacting" includes the physical contact of at least one substance to another substance.

As used herein, the term "electrochemical conversion of carbon dioxide" refers to any electrochemical process where carbon dioxide in any form (e.g., as $CO_2$, carbonate, or bicarbonate) is converted into another chemical substance in any step of the process. Accordingly, as used herein, "carbon dioxide" can be provided in the form of $CO_2$ (gas or in dissolved form), carbonate or bicarbonate (e.g., in dissolved salt or acid form).

The terms "Faradaic efficiency" or "F.E." or "FE" as used herein mean the efficiency with which charge (electrons) are transferred in a system to produce a desired product.

As used herein, the term "overpotential" refers to the potential (voltage) difference between a reaction's thermodynamically determined reduction or oxidation potential and the potential at which the event is experimentally observed.

All percentages, ratios and proportions herein are by weight, unless otherwise specified. A weight percent (weight %, also as wt %) of a component, unless specifically stated to the contrary, is based on the total weight of the composition in which the component is included (e.g., the amount of the helper catalyst).

In view of the present disclosure, the methods and compositions described herein can be configured by the person of ordinary skill in the art to meet the desired need. In general, the disclosed methods and compositions provide improvements in an electrochemical reduction of carbon dioxide. For example, in certain aspects, the compositions and methods of the disclosure operate at lower overpotentials, and at higher rates and high electron conversion efficiencies and selectivities. Specifically, in certain aspects of the disclosure, the carbon dioxide reduction reaction at transition metal dichalcogenide (TMDC), such as molybdenum disulfide ($MoS_2$), can be initiated at a very low overpotential (e.g., 54 mV) for CO formation in the system. TMDCs such as $MoS_2$ can also exhibit a significantly high $CO_2$ reduction current density (e.g., 65 mA/cm$^2$), where $CO_2$ is selectively converted to CO (F.E.~98%). Additionally, $CO_2$ can be converted at TMDC such as $MoS_2$ into a tunable mixture of $H_2$ and CO (syngas), ranging in each component from zero to ~100%. The $MoS_2$ Scanning Transition Electron Microscopy (STEM) analysis and Density Function Theory (DFT) calculations evidenced, without being bound by a particular theory, that active molybdenum (Mo) atom enriched edges can have a high electron density (about 20 times higher than bulk Ag) and can be mainly responsible for the exceptional performance and dual catalytic feature of $MoS_2$. Finally, the TMDCs can offer significant cost saving benefits over the traditionally used expensive noble metal catalytic materials, without sacrificing the selectivity and efficiency of the $CO_2$ conversion.

The methods of the disclosure can be carried out in an electrochemical cell. In a general aspect of the disclosure, an electrochemical cell contains an anode, a cathode and an electrolyte in contact with the anode and the cathode. The devices may optionally include a membrane (e.g., disposed between the anode and the cathode), as is common in many electrochemical cells. Catalysts can be in contact on the anode, or cathode, or in the electrolyte to promote desired chemical reactions. In the methods of the disclosure, for example, the transition metal dichalcogenide (such as $MoS_2$) may be in contact with the cathode (e.g., by being disposed thereon), and the helper catalyst can be provided as part of the electrolyte (e.g., an aqueous solution comprising the helper catalyst). In practicing certain such methods, carbon dioxide is fed into the cell, and a voltage is applied between the anode and the cathode, to promote the electrochemical reaction. Of course, one of skill in the art will recognize that other types of electrochemical reactors might be used in the methods of the disclosure, depending on the desired use. For example, microfluidic reactors may be used.

In some embodiments of the disclosure, a three-component electrochemical cell may be used. In a three-component cell a working electrode (WE), counter electrode (CE) and a reference electrode (RE) are in contact with a solution comprising the helper catalyst. In certain methods of the disclosure, for example, the WE serves as a cathode and comprises the transition metal dichalcogenide. In a non-limiting example, silver wire may be used as the RE, platinum net may be used as the CE, and the WE may comprise the transition metal dichalcogenide (such as $MoS_2$).

When an electrochemical cell is used as a carbon dioxide conversion system, a reactant comprising $CO_2$, carbonate, or bicarbonate is fed into the cell. For example, gaseous $CO_2$ may be continuously bubbled through the solution. A voltage is applied to the cell, and the $CO_2$ reacts to form new chemical compounds. As one of skill in the art will recognize, $CO_2$ (as well as carbonate or bicarbonate) may be reduced into various useful chemical products, including but not limited to CO, syngas (mixture of CO and $H_2$), $OH^-$, $HCO^-$, $H_2CO$, $(HCO_2)^-$, $H_2CO_2$, $CH_3OH$, $CH_4$, $C_2H_4$, $CH_3CH_2OH$, $CH_3COO^-$, $CH_3COOH$, $C_2H_6$, $O_2$, $H_2$, $(COOH)_2$, and $(COO^-)_2$. In certain embodiments, $CO_2$ may be reduced to form CO, $H_2$, or a mixture of CO and $H_2$. As demonstrated in certain examples described herein, reaction conditions (e.g., applied potential) can be adjusted to provide predominantly CO, predominantly $H_2$, or a desired mixture of both.

Advantageously, the carbon dioxide used in the embodiments of the invention can be obtained from any source, e.g., an exhaust stream from fossil-fuel burning power or industrial plants, from geothermal or natural gas wells or the atmosphere itself. In certain embodiments, carbon dioxide is anaerobic. In other embodiments, carbon dioxide is obtained from concentrated point sources of its generation prior to its release into the atmosphere. For example, high concentration carbon dioxide sources are those frequently accompanying natural gas in amounts of 5 to 50%, those from flue gases of fossil fuel (coal, natural gas, oil, etc.) burning power plants, and nearly pure $CO_2$ exhaust of cement factories and from fermenters used for industrial fermentation of ethanol. Certain geothermal steams also contain significant amounts of $CO_2$. In other words, $CO_2$ emissions from varied industries, including geothermal wells, can be captured on-site. Separation of $CO_2$ from such exhausts is well-known. Thus, the capture and use of existing atmospheric $CO_2$ in accordance with embodiments of the invention allows $CO_2$ to be a renewable and unlimited source of carbon.

The applied potential can be held constant, e.g., between about −5 to about 5 V vs. reversible hydrogen electrode (V vs. RHE), or between about −2 to about +2 V vs. RHE. In some embodiments, the applied potential is between about −1.5 to about +2 V vs. RHE, or about −1.5 to about +1.5 V vs. RHE, or about −1 to about +1.5 V vs. RHE, or about −0.8 to about +1.2 V vs. RHE. The electrical energy for the electrochemical reduction of carbon dioxide can come from a conventional energy source, including nuclear and alternatives (hydroelectric, wind, solar power, geothermal, etc.), from a solar cell or other non-fossil fuel source of electricity. The minimum value for the applied potential will depend on the internal resistance of the cell employed and on other factors determinable by the person of ordinary skill in the art. In certain embodiments, at least 1.6 V is applied across the cell.

In certain embodiments, the reduction of carbon dioxide may be initiated at high current densities. For example, in certain embodiments, the current density of carbon dioxide reduction is at least 30 mA/cm$^2$, or at least 40 mA/cm$^2$, or at least 50 mA/cm$^2$, or at least 55 mA/cm$^2$, or at least 60 mA/cm$^2$, or at least 65 mA/cm$^2$. In one embodiment, the current density of carbon dioxide reduction is between about 30 mA/cm$^2$ and about 130 mA/cm$^2$, or about 30 mA/cm$^2$ and about 100 mA/cm$^2$, or about 30 mA/cm$^2$ and about 80 mA/cm$^2$, or about 40 mA/cm$^2$ and about 130 mA/cm$^2$, or about 40 mA/cm$^2$ and about 100 mA/cm$^2$, or about 40 mA/cm$^2$ and about 80 mA/cm$^2$, or about 50 mA/cm$^2$ and about 70 mA/cm$^2$, or about 60 mA/cm$^2$ and about 70 mA/cm$^2$, or about 63 mA/cm$^2$ and about 67 mA/cm$^2$, or about 60 mA/cm$^2$, or about 65 mA/cm$^2$, or about 70 mA/cm$^2$.

In certain embodiments, the reduction of carbon dioxide may be initiated at low overpotential. For example, in certain embodiments, the initiation overpotential is less than about 200 mV. In other embodiments, the initiation overpotential is less than about 100 mV, or less than about 90 mV, or less than about 80 mV, or less than about 75 mV, or less than about 70 mV, or less than about 65 mV, or less than about 60 mV, or less than about 57 mV, or less than about 55 mV, or less than about 50 mV. In one embodiment, the reduction of carbon dioxide is initiated at overpotential of about 50 mV to about 57 mV, or about 51 mV to about 57 mV, or about 52 mV to about 57 mV, or about 52 mV to about 55 mV, or about 53 mV to about 55 mV, or about 53 mV, or about 54 mV, or about 55 mV.

The methods described herein can be performed at a variety of pressures and temperatures, and a person of skill in the art would be able to optimize these conditions to achieve the desired performance. For example, in certain embodiments, the methods of the disclosure are performed at a pressure in the range of about 0.1 atm to about 2 atm, or about 0.2 atm to about 2 atm, or about 0.5 atm to about 2 atm, or about 0.5 atm to about 1.5 atm, or or about 0.8 atm to about 2 atm, or about 0.9 atm to about 2 atm, about 0.1 atm to about 1 atm, or about 0.2 atm to about 1 atm, or about 0.3 atm to about 1 atm, or about 0.4 atm to about 1 atm, or about 0.5 atm to about 1 atm, or about 0.6 atm to about 1 atm, or about 0.7 atm to about 1 atm, or about 0.8 atm to about 1 atm, or about 1 atm to about 1.5 atm, or about 1 atm to about 2 atm. In one particular embodiment, the methods of the disclosure are carried at a pressure of about 1 atm. In other embodiments, the methods of the disclosure are carried out at a temperature within the range of about 0° C. to about 50° C., or of about 10° C. to about 50° C., or of about 10° C. to about 40° C., or of about 15° C. to about 35° C., or of about 20° C. to about 30° C., or of about 20° C. to about 25° C., or at about 20° C., or at about 21° C., or at about 22° C., or at about 23° C., or at about 24° C., or at about 25° C. In one particular embodiment, the methods of the disclosure are carried out at a temperature of about 20° C. to about 25° C. The methods of the disclosure may last, for example, for a time within the range of about several minutes to several days and months.

Advantageously, in certain embodiments the methods described herein can be operated at Faradaic efficiency (F.E) of in the range of 0 to 100% for the reduction of carbon dioxide to CO. In some embodiments, the Faradaic efficiency of the carbon dioxide-to-CO reduction is at least about 3%, or at least about 5%, or at least about 8%, or at least about 10%, or at least about 20%, or at least about 25%, or at least about 50%, or at least about 60%, or at least about 70%, or at least about 75%, or at least about 80%, at least about 85%, or at least about 90%, or at least about 91%, or at least about 92%, or at least about 93%, or at least about 94%, or at least about 95%, or at least about 96%, or at least about 97%, or at least about 98%, or at least about 99%.

The catalysts used in the methods and compositions of the disclosure can be selected to reduce carbon dioxide via an electrochemical reaction. The catalysts comprise at least one transition metal dichalcogenide. Examples of transition metal dichalcogenides include the group consisting of $TiX_2$, $VX_2$, $CrX_2$, $ZrX_2$, $NbX_2$, $MoX_2$, $HfX_2$, $WX_2$, $TaX_2$, $TcX_2$, and $ReX_2$, wherein X is independently S, Se, or Te. In one embodiment, the transition metal dichalcogenide is selected from the group consisting of $TiX_2$, $MoX_2$, and $WX_2$, wherein X is independently S, Se, or Te. In another embodiment, the transition metal dichalcogenide is selected from the group consisting of $TiS_2$, $TiSe_2$, $MoS_2$, $MoSe_2$, $WS_2$ and $WSe_2$. For example, in one embodiment, the transition metal dichalcogenide is $TiS_2$, $MoS_2$, or $WS_2$. In another embodiment, the transition metal dichalcogenide is $MoS_2$ or $MoSe_2$. The transition metal dichalcogenide may be $MoS_2$ in one embodiment.

Figure 15:
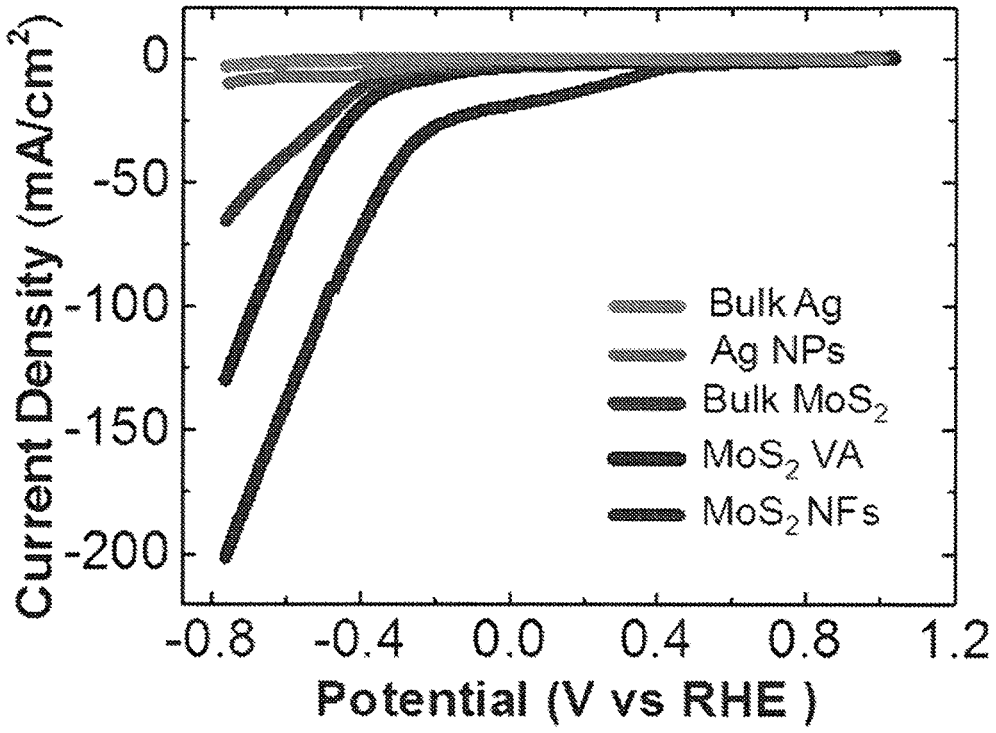
FIG. 15 shows cyclic voltammetry curves for different catalysts for $CO_2$ reduction in 90 mol % water and 10 mol % IL. From bottom to top: $MoS_2$ nanoflakes (NFs), vertically aligned $MoS_2$ (VA), bulk $MoS_2$, silver nanoparticles (NPs) and bulk silver. Synthesized $MoS_2$ NFs show the best $CO_2$ reduction performance compare to others in same experimental condition.

One of skill in the art will recognize that the transition metal dichalcogenides may be used in the form of bulk materials, nanostructures, collections of particles, supported particles, small metal ions, or organometallics. As the person of ordinary skill in the art will appreciate, the TMDC in bulk form may be in natural layered structure. The TMDC may have a nanostructure morphology, including but not limited to monolayers, nanotubes, nanoparticles, nanoflakes, multilayer flakes, nanosheets, nanoribbons, nanoporous solids etc. As used herein, the term nanostructure refers to a material with a dimension (e.g., of a pore, a thickness, a diameter, as appropriate for the structure) in the nanometer range. In some embodiments, the catalyst is layer-stacked bulk $MoS_2$ with molybdenum terminated edges. In other embodiments, $MoS_2$ nanoparticles may be used in the methods of the disclosure. In other embodiments, vertically aligned nanoflakes of $MoS_2$ may be used in the methods of the disclosure. In other embodiments, nanoribbons of $MoS_2$ may be used in the methods of the disclosure. In some other embodiments, nanosheets of $MoS_2$ may be used in the methods of the disclosure. It is worth nothing that, in certain methods of the disclosure, TMDCs in bulk form outperform the noble metals at least two fold, and the TMDCs in nanoflake form outperform the noble metals at least one order of magnitude (results shown in FIG. 15).

In certain embodiments, the transition metal dichalcogenide nanostructures (e.g., nanoparticles, nanoribbons, etc.) have an average size between about 1 nm and 1000 nm. In some embodiments, the transition metal dichalcogenide nanostructures have an average size between from about 1 nm to about 400 nm, or about 1 nm to about 350 nm, or about 1 nm to about 300 nm, or about 1 nm to about 250 nm, or about 1 nm to about 200 nm, or about 1 nm to about 150 nm, or about 1 nm to about 100 nm, or about 1 nm to about 80 nm, or about 1 nm to about 70 nm, or about 1 nm to about 50 nm, or 50 nm to about 400 nm, or about 50 nm to about 350 nm, or about 50 nm to about 300 nm, or about 50 nm to about 250 nm, or about 50 nm to about 200 nm, or about 50 nm to about 150 nm, or about 50 nm to about 100 nm, or about 10 nm to about 70 nm, or about 10 nm to about 80 nm, or about 10 nm to about 100 nm, or about 100 nm to about 500 nm, or about 100 nm to about 600 nm, or about 100 nm to about 700 nm, or about 100 nm to about 800 nm, or about 100 nm to about 900 nm, or about 100 nm to about 1000 nm, or about 400 nm to about 500 nm, or about 400 nm to about 600 nm, or about 400 nm to about 700 nm, or about 400 nm to about 800 nm, or about 400 nm to about 900 nm, or about 400 nm to about 1000 nm. In certain embodiments, the transition metal dichalcogenide nanostructures have an average size between from about 1 nm to about 200 nm. In certain other embodiments, the transition metal dichalcogenide nanostructures have an average size between from about 1 nm to about 400 nm. In certain other embodiments, the transition metal dichalcogenide nanostructures have an average size between from about 400 nm to about 1000 nm.

One of skill in the art will also recognize that the term "helper catalyst" refers to an organic molecule or mixture of organic molecules that does at least one of the following: (a) speeds up the carbon dioxide reduction reaction, or (b) lowers the overpotential of the carbon dioxide reduction reaction, without being substantially consumed in the process. The helper catalysts useful in the methods and the compositions of the disclosure are described in detail in International Application Nos. PCT/US2011/030098 (published as WO 2011/120021) and PCT/US2011/042809 (published as WO 2012/006240) and in U.S. Publication No. 2013/0157174, each of which is hereby incorporated herein by reference in its entirety. In certain embodiments, the helper catalyst is a compound comprising at least one positively charged nitrogen, sulfur, or phosphorus group (for example, a phosphonium or a quaternary amine). Aqueous solutions including one or more of: ionic liquids, deep eutectic solvents, amines, and phosphines; including specifically imidazoliums (also called imidazoniums), pyridiniums, pyrrolidiniums, phosphoniums, ammoniums, choline sulfoniums, prolinates, and methioninates can form complexes with $(CO_2)^-$, and as a result, can serve as the helper catalysts. Specific examples of helper catalysts include, but are not limited to, one or more of acetylcholines, alanines, aminoacetonitriles, methylammoniums, arginines, aspartic acids, threonines, chloroformamidiniums, thiouroniums, quinoliniums, pyrrolidinols, serinols, benzamidines, sulfamates, acetates, carbamates, inflates, and cyanides. These examples are meant for illustrative purposes only, and are not meant to limit the scope of the present invention. Aqueous solutions including the helper catalysts described herein can be used as the electrolyte. Such aqueous solutions can include other species, such as acids, bases and salts, in order to provide the desired electrochemical and physicochemical properties to the electrolyte as would be evident to the person of ordinary skill in the art.

In certain embodiments, the helper catalysts of the disclosure include, but are not limited to imidazoliums, pyridiniums, pyrrolidiniums, phosphoniums, ammoniums, sulfoniums, prolinates, and methioninates salts. The anions suitable to form salts with the cations of the helper catalysts include, but are not limited to $C_1$-$C_6$ alkylsulfate, tosylate, methanesulfonate, bis(trifluoromethylsulfonyl)imide, hexafluorophosphate, tetrafluoroborate, triflate, halide, carbamate, and sulfamate. In particular embodiments, the helper catalysts may be a salt of the cations selected from those in Table 1.

TABLE 1

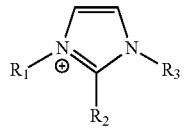
imidazolium

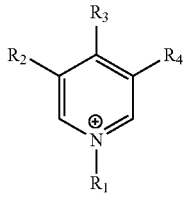
pyridinium

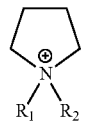
pyrrolidinium

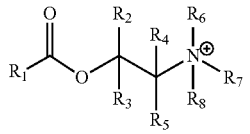
acetylcholine

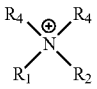
ammonium

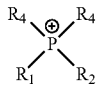
phosphonium

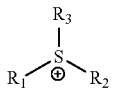
sulfonium

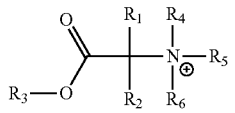
alanine

TABLE 1-continued

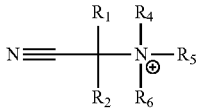

acetonitrile

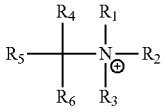

methylammoniunn

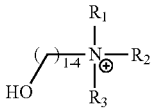

choline

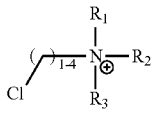

chlorocholine

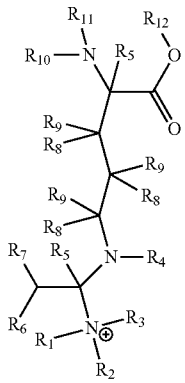

arginine

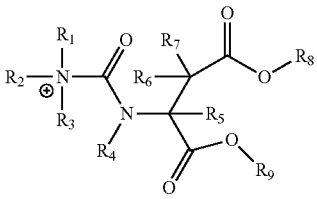

aspartic acid

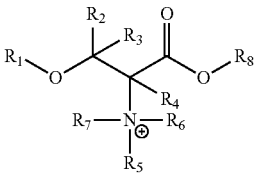

threonine

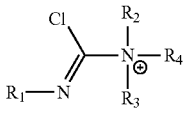

chloroformamidinium

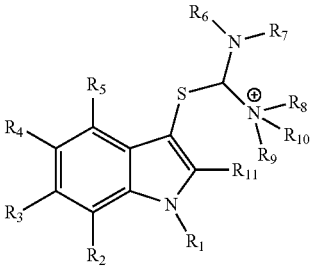

thiuronium

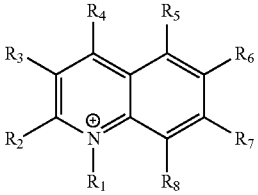

propulisoquinolinium

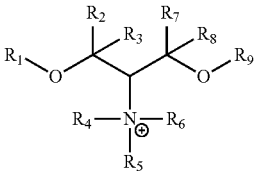

serinol

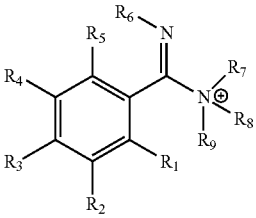

benzamidine

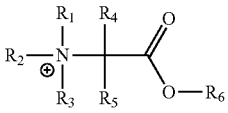

sarcosines wherein $R_1$-$R_{12}$ are independently selected from the group consisting of hydrogen, —OH, linear aliphatic $C_1$-$C_6$ group, branched aliphatic $C_1$-$C_6$ group, cyclic aliphatic $C_1$-$C_6$ group, —$CH_2OH$, —$CH_2CH_2OH$, —$CH_2CH_2CH_2OH$, —$CH_2CHOHCH_3$, —$CH_2COH$, —$CH_2CH_2COH$, and —$CH_2COCH_3$.

In certain embodiments, the helper catalyst of the methods and compositions of the disclosure is imidazolium salt of formula:

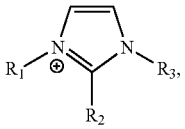

wherein $R_1$, $R_2$, and $R_3$ are independently selected from the group consisting of hydrogen, linear aliphatic $C_1$-$C_6$ group, branched aliphatic $C_1$-$C_6$ group, and cyclic aliphatic $C_1$-$C_6$ group. In other embodiments, $R_2$ is hydrogen, and $R_1$ and $R_3$ are independently selected from linear or branched $C_1$-$C_4$ alkyl. In particular embodiments, the helper catalyst of the disclosure is 1-ethyl-3-methylimidazolium salt. In other embodiments, the helper catalyst of the disclosure is 1-ethyl-3-methylimidazolium tetrafluoroborate (EMIM-$BF_4$).

In some embodiments, the helper catalyst may be neutral organics, such as 2-amino alcohol derivatives, isoetarine derivatives, and norepinepherine derivatives. These examples are meant for illustrative purposes only, and are not meant to limit the scope of the present invention.

Of course, not every substance that forms a complex with $(CO_2)^-$ will act as a helper catalyst. When an intermediate binds to a catalyst, the reactivity of the intermediate decreases. If the intermediate bonds too strongly to the catalyst, the intermediate will become unreactive, so the substance will not be effective. The person of ordinary skill in the art will understand that this can provides a key limitation on substances that act as helper catalysts, and will select the helper catalyst accordingly.

In general, a person of skill in the art can determine whether a given substance (S) is a helper catalyst for a reaction (R) catalyzed by TMDC as follows:

(a) fill a standard 3 electrode electrochemical cell with the electrolyte commonly used for reaction R. Common electrolytes include such as 0.1 M sulfuric acid or 0.1 M KOH in water can also be used;
(b) mount the TMDC into the 3 electrode electrochemical cell and an appropriate counter electrode;
(c) run several CV cycles to clean the cell;
(d) measure the reversible hydrogen electrode (RHE) potential in the electrolyte;
(e) load the reactants for the reaction R into the cell, and measure a CV of the reaction R, noting the potential of the peak associated with the reaction R;
(f) calculate VI, which is the difference between the onset potential of the peak associated with reaction and RHE;
(g) calculate VIA, which is the difference between the maximum potential of the peak associated with reaction and RHE;
(h) add 0.0001 to 99.9999 weight % of the substance S to the electrolyte;
(i) measure RHE in the reaction with helper catalyst;
(j) measure the CV of reaction R again, noting the potential of the peak associated with the reaction R;
(k) calculate V2, which is the difference between the onset potential of the peak associated with reaction and RHE; and
(l) calculate V2A, which is the difference between the maximum potential of the peak associated with reaction and RHE.

If V2<V1 or V2A<VIA at any concentration of the substance S (e.g., between 0.0001 and 99.9999 weight %), the substance S is a helper catalyst for the reaction.

The person of skill in the art will also recognize that the benefits of the helper catalyst may be realized at small amount of the helper catalyst relative to the transition metal dichalcogenide. One can obtain an estimate of the helper catalyst amount needed to change the reaction from a Pease study ("The Catalytic Combination of Ethylene and Hydrogen in the Presence of Metallic Copper III. Carbon Monoxide as a Catalyst Poison" *J. Am. Chem. Soc.,* 1925, 47(5), pp 1235-1240), which is incorporated into this disclosure by reference in its entirety) of the effect of carbon monoxide (CO) on the rate of ethylene hydrogenation on copper. Pease found that 0.05 cc (62 micrograms) of carbon monoxide (CO) was sufficient to almost completely poison a 100 gram catalyst towards ethylene hydrogenation. This corresponds to a poison concentration of 0.0000062% by weight of CO in the catalyst. Those familiar with the technology involved here know that if 0.0000062% by weight of the poison in a catalytically active element-poison mixture could effectively suppress a reaction, then as little as 0.0000062% by weight of the helper catalyst relative to the amount of the transition metal dichalcogenide could enhance a reaction. This provides an example of a lower limit to the helper catalyst concentration relative to the transition metal dichalcogenide. Thus, in certain embodiments, the helper catalyst is present from about 0.000005 weight % to about 50 weight % relative to the weight of transition metal dichalcogenide. In some other embodiments, the amount of the helper catalyst is between about 0.000005 weight % to about 20 weight %, or about 0.000005 weight % to about 10 weight %, or about 0.000005 weight % to about 1 weight %, or about 0.000005 weight % to about 0.5 weight %, or about 0.000005 weight % to about 0.05 weight %, or about 0.00001 weight % to about 20 weight %, or about 0.00001 weight % to about 10 weight %, or about 0.00001 weight % to about 1 weight %, or about 0.00001 weight % to about 0.5 weight %, or about 0.00001 weight % to about 0.05 weight %, or about 0.0001 weight % to about 20 weight %, or about 0.0001 weight % to about 10 weight %, or about 0.0001 weight % to about 1 weight %, or about 0.0001 weight % to about 0.5 weight %, or about 0.0001 weight % to about 0.05 weight %.

Further, the helper catalyst may be dissolved in water or other aqueous solution, a solvent for the reaction, an electrolyte, an acidic electrolyte, a buffer solution, an ionic liquid, an additive to a component of the system, or a solution that is bound to at least one of the catalysts in a system. These examples are meant for illustrative purposes only, and are not meant to limit the scope of the present invention. Thus, in one embodiment, the helper catalyst is present in water.

In some embodiments (for example, when the helper catalyst is EMIM-$BF_4$), the helper catalyst is present in an aqueous solution (for example, water) within the range from about 0.1 mol % to about 40 mol %, or about 0.1 mol % to about 35 mol %, or about 0.1 mol % to about 30 mol %, or about 0.1 mol % to about 25 mol %, or about 0.1 mol % to about 20 mol %, or about 0.1 mol % to about 15 mol %, or about 0.1 mol % to about 10 mol %, or about 0.1 mol % to about 8 mol %, or about 0.1 mol % to about 7 mol %, or about 0.1 mol % to about 6 mol %, or about 0.1 mol % to about 5 mol %, or about 1 mol % to about 20 mol %, or about 1 mol % to about 15 mol %, or about 1 mol % to about 10 mol %, or about 1 mol % to about 8 mol %, or about 1 mol % to about 7 mol %, or about 1 mol % to about 6 mol %, or about 1 mol % to about 5 mol %, or about 3 mol % to about 15 mol %, or about 3 mol % to about 10 mol %, or about 4 mol % to about 15 mol %, or about 4 mol % to about 12 mol %, or about 4 mol % to about 10 mol %, or about 1 mol %, or about 2 mol %, or about 3 mol %, or about 4 mol %, or about 5 mol %, or about 6 mol %, or about 7 mol %, or about 8 mol %, or about 9 mol %, or about 10 mol %, or about 12 mol % of the aqueous solution. In certain embodiments, the helper catalyst is present in an aqueous solution within the range from about 4 mol % to about 10 mol %, or about 3 mol % to about 5 mol %. In some other embodiments, the helper catalyst is present in an aqueous solution at about 4 mol %. One of skill in the art understands that the mol % may be calculated by dividing the number of moles of the helper catalyst with the sum of moles of the helper catalyst and the aqueous solution.

In some embodiments (for example, when the helper catalyst is EMIM-$BF_4$), the helper catalyst is present in an aqueous solution (for example, water) within the range from about 1 weight % to about 90 weight %, or about 1 weight % to about 80 weight %, or about 1 weight % to about 70 weight %, or about 1 weight % to about 60 weight %, or about 1 weight % to about 50 weight %, from about 10 weight % to about 90 weight %, or about 10 weight % to about 80 weight %, or about 10 weight % to about 70 weight %, or about 10 weight % to about 60 weight %, or about 10 weight % to about 50 weight %, or about 20 weight % to about 90 weight %, or about 20 weight % to about 80 weight %, or about 20 weight % to about 70 weight %, or about 20 weight % to about 60 weight %, or about 20 weight % to about 50 weight %, or about 30 weight % to about 90 weight %, or about 30 weight % to about 80 weight %, or about 30 weight % to about 70 weight %, or about 30 weight % to about 60 weight %, or about 30 weight % to about 50 weight %, or about 30 weight %, or about 35 weight %, or about 40 weight %, or about 45 weight %, or about 50 weight %, or about 55 weight %, or about 60 weight of the aqueous solution. In certain embodiments, the helper catalyst is present in an aqueous solution within the range from about 27 weight % to about 55 weight %, or about 30 weight % to about 50 weight %. In some other embodiments, the helper catalyst is present in an aqueous solution at about 30 weight %.

The methods of the disclosure are illustrated further by the following examples, which are not to be construed as limiting the disclosure in scope or spirit to the specific procedures and in them.

Example 1: $MoS_2$ Characterization

Morphology of $MoS_2$ was visualized at different scales. Optical characterizations were performed by using a Stereo-F (16×-100× microscope) at 2× magnification and digital images of bulk $MoS_2$ (purchased through SPI Supplies) were taken using a 5 mega pixels (MP) CCD camera mounted on the microscope. Scanning Electron Microscopy (SEM) was performed in order to characterize the morphology of the bulk $MoS_2$ at micro scale. The instrument used for characterization is integrated in a Raith e-LiNE plus ultra-high resolution electron beam lithography system. During imaging the samples were kept at a distance of 10 mm from the electrons source and the voltage was kept at 10 kV. No particular types of preparation were implemented before imaging. To visualize atomic structure, scanning transmission electron microscopy (STEM) was performed using a probe-corrected JEOL JEM-ARM200CF equipped with a 200 kV cold-field emission gun (CFEG). Images were acquired in either the high or low angle annular dark field (H/LAADF), with the former providing an approximately $Z^2$ contrast, while the latter is more sensitive to lower angle scattering. A 14 mrad probe convergence angle was used for imaging, with the HAADF and LAADF detector angles set to 54-220 and 24-96 mrad, respectively. Annular bright field (ABF) images were also collected in order to identify S atomic columns, as ABF excels in the imaging of light elements; a collection angle of 7-14 mrad was used. For STEM experiments, $MoS_2$ flakes obtained by mechanical exfoliation of bulk $MoS_2$ (standard Scotch-tape method) were directly transferred on QUANTIFOIL® R 2/1 Holey films with 2 μm circular holes by copper grid (200 mesh, purchased from the Electron Microscopy Sciences). The intensity line profile was attained by using Gatan Digital Micrograph. Both the Web Electron Microscopy Applications Software (WebEMAPS) and CrystalMaker Software programs were also employed to generate and visualize the crystal structures schematically.

Example 2: Raman Spectroscopy

Raman spectroscopy (Renishaw Raman 2000) was used to detect the $MoS_2$ in-plane and out of plane phonon mode. The spectrum was obtained by exposing small pieces of the samples i.e. bulk $MoS_2$ (without any particular treatment) to 514 nm laser beam (Ar laser, power 10 mW and spot size 10 μm).

Example 3: Ultraviolet Photoelectron Spectroscopy (UPS)

Surface work function measurements were carried out using ultraviolet photoelectron spectroscopy (UPS). UPS data were acquired with a Physical Electronics PHI 5400 photoelectron spectrometer using Hel (21.2 eV) ultraviolet radiation and a pass energy of 8.95 eV. To separate the signal arising from secondary electron emission from the detector from the secondary electron emission from the sample, a −9 V bias was applied to the sample using a battery.

Example 4: Electrochemical Experiments

Figure 4:
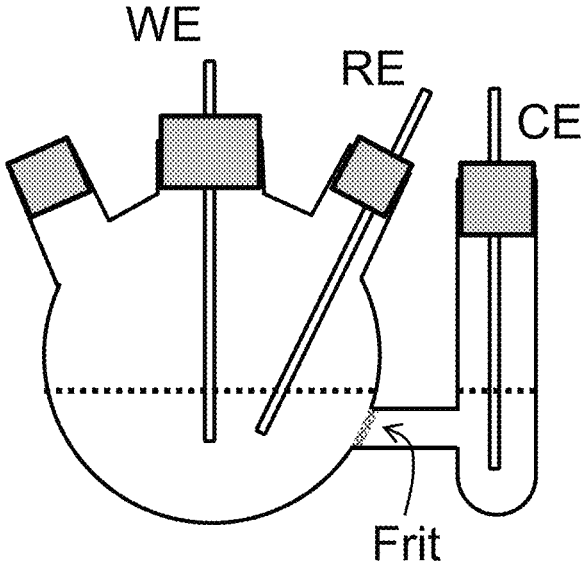
FIG. 4 shows an optical image of 2-compartment three-electrode electrochemical cell. The working electrode (WE), counter electrode (CE) and the reference electrode (RE) are immerged in the ionic liquid solution (EMIM-$BF_4$) and connected to the potentiostat for electrolysis characterization. Silver wire and platinum net were used as RE and CE respectively. A 6 mm diameter polyethylene tube is used for bubbling the gas (Argon or $CO_2$) into the solution time.

In order to examine the catalytic activity of $MoS_2$ for $CO_2$ reduction, electrochemical experiments were carried out in a custom made 2-compartment three-electrode electrochemical cell (FIG. 4). The compartments were separated by a physical barrier using glass frit. Bulk $MoS_2$ (purchased through SPI Supplies), platinum (Pt) gauze 52 mesh (purchased via Alfa Aesar) and Ag wire (annealed 99.9% metal basis, purchased from Alfa Aesar) were used as working, counter and reference electrode respectively. 1-ethyl-3-nnethylimidazolium tetrafluoroborate (EMIM-$BF_4$) was purchased through Sigma-Aldrich. Electrolytes with different water mole fractions were prepared by adding known volume of DI water into EMIM-$BF_4$. Electrochemical $CO_2$ reduction experiments were performed in anaerobic $CO_2$ (AirGas) saturated electrolyte. The applied voltage was swept between +1.0 and −0.764 V vs. RHE (reversible hydrogen electrode) with a 15 mV/s scan rate. Cyclic voltammetry (CV) curve was then recorded using a Voltalab PGZ100 potentiostat (purchased via Radiometer Analytical SAS) calibrated with a RCB200 resistor capacitor box. The potentiostat was connected to a PC using Volta Master (version 4) software. For chrono-Amperometry (CA) measurement, $CO_2$ concentration was kept constant with bubbling high purity $CO_2$ in solution along with mixing during experiment. Current densities were normalized with catalyst geometrical surface area.

Example 5: Product Analysis

Electrochemical experimental yields were analyzed by gas chromatography (GC) in SRI 8610C GC system equipped with 72×⅛ inch S.S. molecular sieve packed column and a Thermal Conductivity Detector (TCD). Production of carbon monoxide (CO) and hydrogen ($H_2$) was examined separately. Ultra High Purity (UHP) Helium (purchased through AirGas) was used as a carrier gas for CO detection whereas UHP Nitrogen (Air Gas) was utilized for $H_2$ detection. Initially, GC system was calibrated for CO and $H_2$. A JEOL GCMate II (JEOL USA, Peabody Mass.) gas chromatograph/mass spectrometer was further used to prove that yielded CO is only $CO_2$ electrochemical reduction product. The gas chromatograph was an Agilent 6890Plus (Wilmington Del.) equipped with a G1513A auto-injector with 100 vial sample tray connected to a G1512A controller. The gas chromatography column was a fused silica capillary column with a nonpolar 5% phenyl 95% dimethylpolysiloxane phase (Agilent HP-5 ms Ultra Inert), 30 meters long, 0.25 mm internal diameter, 0.25 um film thickness.

Figure 14:
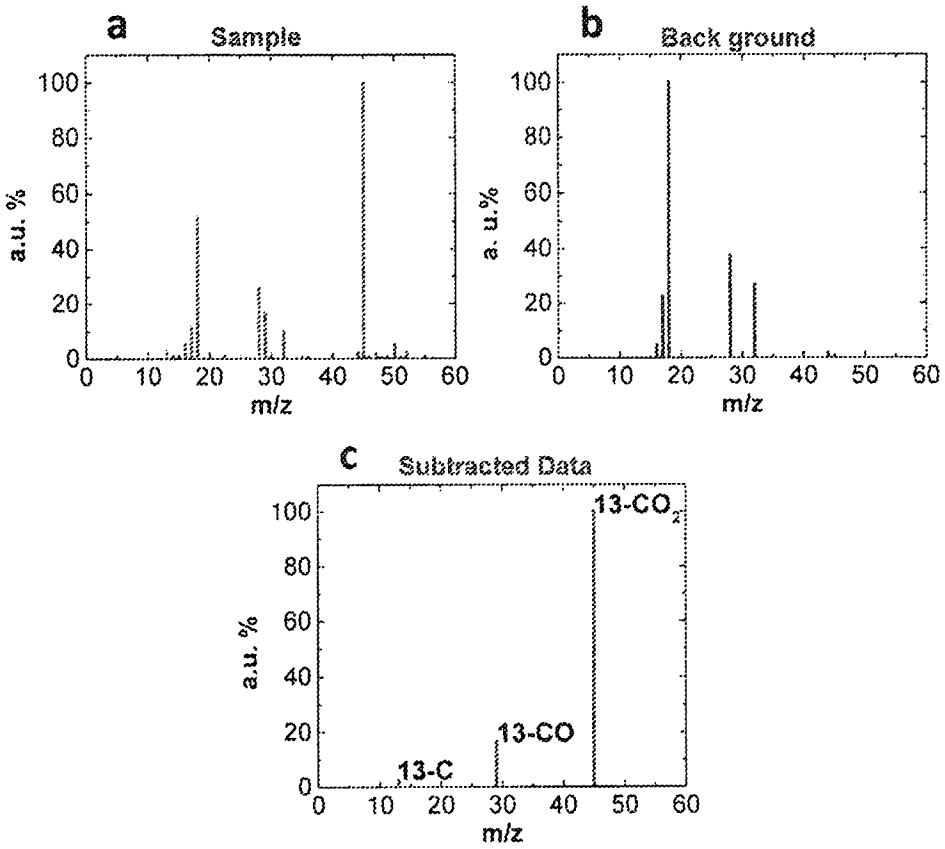
FIG. 14 shows gas chromatography/mass spectroscopy of 2 mL gas sample extracted from sealed three-electrode electrochemical cell. m/z stands for mass-to-charge ratio. (a) Raw sample data which is injected to GC-Mass spectroscopy for gas detection, (b) back ground gas data, and (c) deconvoluted data which is derived from subtracting raw sample data from background data.

In order to confirm that the CO product is derived from $CO_2$, an isotope $13CO_2$ was used as feedstock and GC-Mass spectroscopy was used for gas detection. Mass spectrometer was a bench top magnetic sector operating at a nominal resolving power of 500 using an accelerating voltage of 2500 volts. The spectrometer was operated in full scan EI mode (+Ve) with the filament operating at 70 eV scanning from m/z 10 to m/z 400 using a linear magnet scan. The scan speed was 0.2 sec per scan. Data analysis was performed using the TSSPro software (Shrader Analytical & Consulting Laboratories, Inc., Detroit Mich.) provided with the spectrometer. Mass calibration was performed using perflourokerosene (PFK). The results are discussed in supplementary file (FIG. 14).

Example 6: Synthesize of Vertically Aligned $MoS_2$

Vertically aligned $MoS_2$ nanoflakes were grown by chemical vapor deposition (CVD) using a slightly modified method as reported previously. At first, substrates (Glassy carbon) were thoroughly cleaned via rinsing in acetone, methanol and isopropanol solvents sequentially followed by drying in nitrogen flow. Next, a thin layer of molybdenum (5 nm) was deposited on the substrates by electron beam evaporation (Varian Evaporation System). For sulfurization, Mo deposited substrates were loaded in the center of a three zone furnace (MTI Corp. model OTF-1200X) consisting precise temperature and gas flow controller units. The sulfur precursor purchased from Sigma-Aldrich was placed in the upstream of the growing chamber where the maximum temperature reached to 200° C., above than the sulfur melting point. Prior to heating process, the chamber was evacuated to 5 mTorr and then the argon (Ar) gas was purged through the chamber to force undesired gases out. Then, the center of the furnace was heated to 600° C. in 30 minutes and kept constant for next 15 minutes. During this growth process, Ar gas was continuously flown (200 SCCM) as a carrier gas. Finally, growth chamber was cooled down to ambient temperature under the protection of Ar gas flow and samples were taken out for further experiments. Physical and electrochemical characteristics of vertically aligned $MoS_2$ were characterized as previously discussed.

Example 7: Density Functional Theory (DFT) Calculation

Spin-polarized DFT calculations of $MoS_2$ was performed using SIESTA 3.1 with the Perdew-Burke-Ernzerh of exchange-correlation functional and the norm-conserving Troullier-Martins pseudopotentials to describe valence electrons. The calculations were performed on a real-space grid with a mesh cut-off of 400 Ry within the eigenvalue tolerance of $10^{-4}$ eV, using a DZP (double-zeta basis and polarization orbitals) basis set. The Brillouin zones of the unit cells were sampled by the Monkhorst-Pack grid with a spacing between k-points of $\Delta k<0.01$ $Å^{-1}$. The geometry optimization was carried out within the conjugated gradient algorithm, until all the forces are $F<0.04$ eV/Å and the stress in the periodic direction is $\sigma<0.01$ GPa. QM/MM simulations were performed using TeraChem. The energies and forces were evaluated using the B3LYP exchange-correlation functional with 3-21 g basis set with DFT-D dispersion corrections. The charges were calculated within the Mulliken scheme. The results are discussed in supplementary file.

Example 8: Results

The layer stacked bulk $MoS_2$ with molybdenum (Mo) terminated edges exhibits the highest $CO_2$ reduction performance reported yet. This performance was shown in a diluted solution of 1-ethyl-3-methylimidazolium tetrafluoroborate (EMIM-$BF_4$) ionic liquid i.e. 4 mol % EMIM-$BF_4$ and 96 mol % water. It is believed that EMIM-$BF_4$ makes the system more selective for CO formation rather than hydrogen ($H_2$) production. In the same diluted electrolyte, commonly used silver nanoparticles (Ag NPs) exhibit moderate performance while a bulk silver (Ag) catalyst is unable to reduce $CO_2$. Without being bound to a particular theory, it is believed that the high catalytic activity of bulk $MoS_2$ is attributed to the Mo terminated edges, where the Mo atoms possess approximately one order of magnitude higher (d orbital) electronic density than Ag atoms at the surface of an Ag film, as shown by the first principle calculations. The lower work function (3.9 eV) also promotes the advanced performance of the $MoS_2$ catalyst. The performance of the $MoS_2$ catalyst is further improved by designing an atomic edge terminated surface via synthesizing vertically aligned $MoS_2$.

Figure 2:
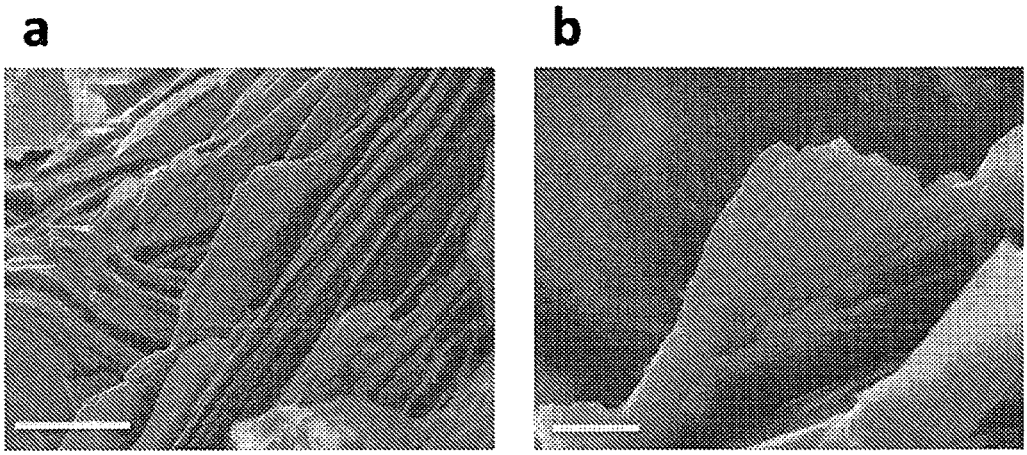
FIG. 2 shows scanning electron microscopic (SEM) images of bulk $MoS_2$. (a) The natural layered structure of bulk $MoS_2$ is simply visible (scale bar, 20 μm). (b) High magnification image (scale bar, 2 μm) more clearly demonstrates the sharp $MoS_2$ edges which are believed to be more electrochemically active sites for $CO_2$ reduction.
Figure 3:
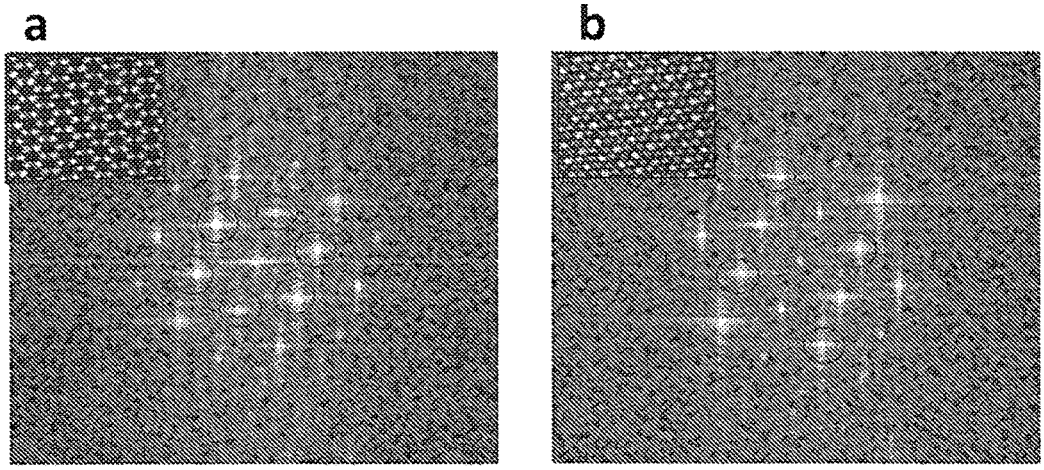
FIG. 3 shows Fast Fourier Transformer (FFT) analyses of $MoS_2$. (a) The symmetrical hexagonal pattern represents the 2H (triangular prismatic) atomic arrangement while (b) shows 1T (octahedral) pattern. Corresponding STEM images are shown in insets. The main difference between the 2H and 1T FFTs is represented by intensity shifting to be mainly in the reflections indicated in the right image. This indicates a preferential ordering (of Mo atoms) in atomic planes perpendicular to the circled spots in the right FFT. This can readily be seen because of the heavy element (Mo) contrast in the high angle annular dark field (HAADF) images.

FIG. 1*a-b* shows optical and scanning electron microscopy (SEM) images, respectively, of the layered structure of bulk $MoS_2$ sample (FIG. 2). Such layered assemblies offer a large number of edges (inset of FIG. 1*b*), which are believed to be highly electro-catalytically active sites in electrochemical reactions. To further detail the atomic arrangement, scanning transmission electron microscopy (STEM) analysis was performed on several mechanically exfoliated, mono- and multi-layer thick sheets of $MoS_2$ flakes. Since the STEM high-angle annular dark-field (HAADF) image intensity relies on the atomic number (Z), it delivers direct information about the arrangement of Mo and S atoms in the $MoS_2$ film. The results of the STEM structural (FIG. 1*c*) and Fast Fourier transform (FFT) analyses (FIG. 3) show that the $MoS_2$ layers are made of two clearly distinct structural domains consisting of 1T (octahedral) and 2H (triangular prismatic). The magnified images (atomic resolution) of selected regions confirm the co-existence of both 1T and 2H atomic arrangements (FIG. 1*d*).

Identification of the atoms on the $MoS_2$ edges is also crucially important, as the Mo and S atoms possess entirely different electronic structures. FIG. 1*e* shows the edge of a $MoS_2$ flake imaged in HAADF and low-angle annular dark-field (LAADF) (inset) mode. The line intensity profiles (plotted towards vacuum) suggest that the edges of the $MoS_2$ flakes are Mo terminated (FIG. 1*f*). This finding is in agreement with the earlier report that the Mo-terminated edges have the lowest formation energy in free-standing single layer $MoS_2$. In rare instances, a substitutional defect (atom) appears at the $MoS_2$ edge. Based on the LAADF image (inset of FIG. 1*e*) and the line intensity profile (gray line), it is clear that this is a lighter atom (compared to S), most likely a carbon atom (from the underlying holey carbon STEM grid). Hence, the STEM analysis undoubtedly validates the presence of Mo atoms on the edges of $MoS_2$ flakes.

Figure 5:
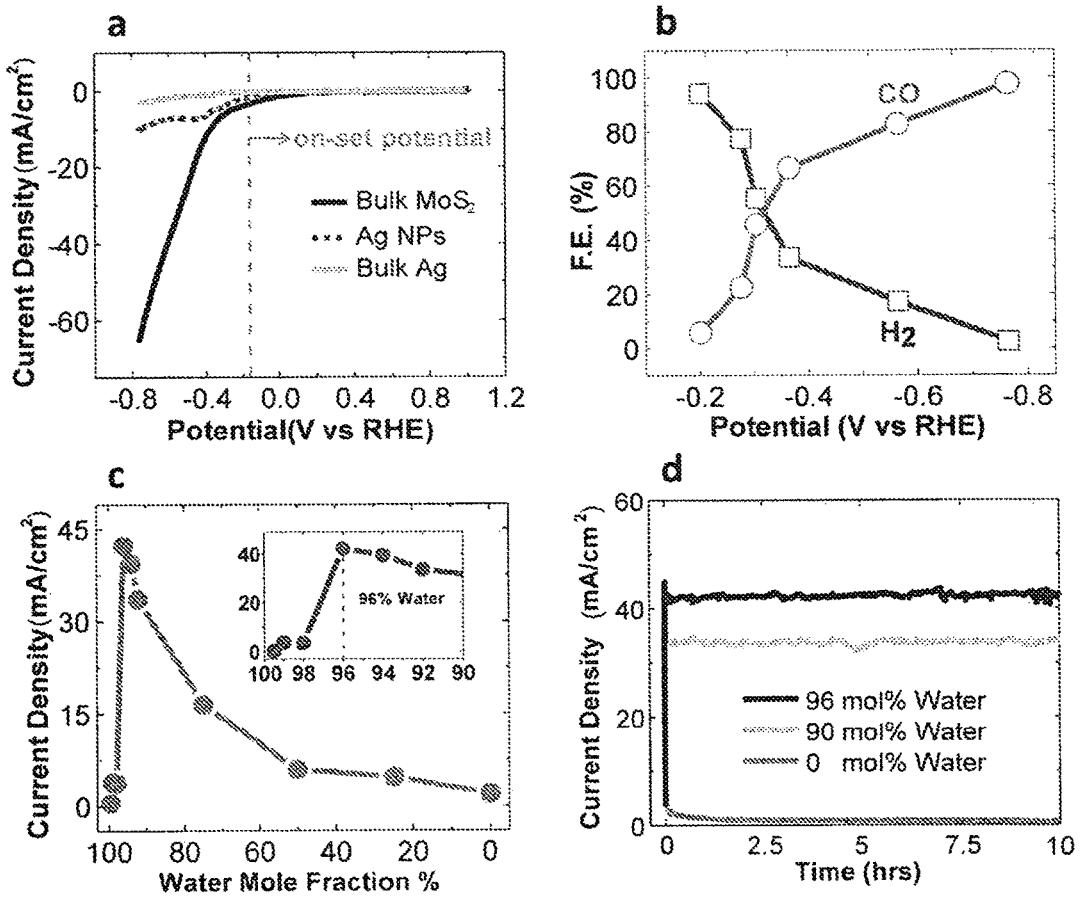
FIG. 5 shows the $CO_2$ reduction performance of the bulk $MoS_2$ catalyst in the EMIM-$BF_4$ solution: (a) Cyclic voltammetric (CV) curves for bulk $MoS_2$, Ag nanoparticles (Ag NPs) and bulk Ag in $CO_2$ environment. The experiments were performed in 96 mol % water and 4 mol % EMIM-$BF_4$ solution by sweeping applied potential from +1 V to −0.764 V vs RHE. The vertical gray line indicates the low overpotential (~54 mV) for $CO_2$ reduction at bulk $MoS_2$. (b) CO and $H_2$ Faradaic Efficiency (F.E.) at different applied potentials. (c) The current density of $CO_2$ reduction (measured by Chrono-Amperometry) at −0.764 V vs. RHE as a function of water mole fraction in 4 mol % EMIM-$BF_4$ electrolyte. The pH value of the solutions was also monitored. (d) Chrono-Amperometry results of $MoS_2$ catalyst in different solutions (96 mol %, 90 mol % and 0 mol % water) showing negligible loss in current density even after 10 hours.
Figure 6:
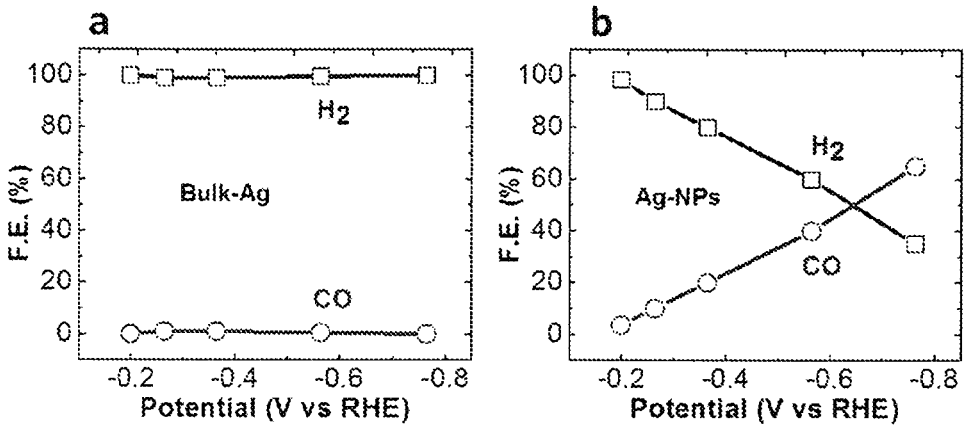
FIG. 6 shows Faradic efficiency (F.E.) measurement for Ag nanoparticles (Ag NPs) and bulk Ag. Ag nanoparticles and bulk Ag $CO_2$ reduction performance was examined in 4 mol % EMIM-$BF_4$ solution in DI water at different potentials. (a) CO and $H_2$ formation Faradic Efficiency (F.E.) for bulk Ag and (b) Ag nanoparticles (Ag NPs). At the highest applied potential, the CO formation F.E. remains only 65% for Ag NPs while bulk Ag is unable to reduce $CO_2$ at any applied potential under these experimental conditions (4 mol % EMIM-$BF_4$ solution).
Figure 7:
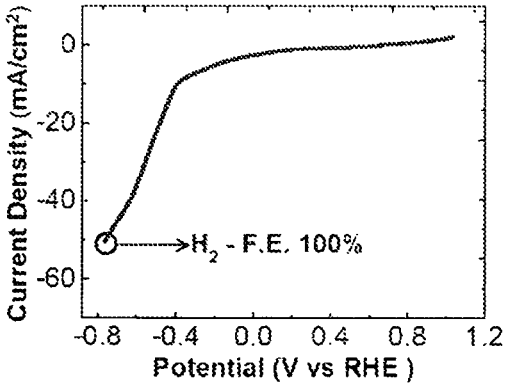
FIG. 7 illustrates the catalytic performance of bulk $MoS_2$ catalyst in argon (Ar) environment. Cyclic voltammetric (CV) curves of bulk $MoS_2$ catalyst in the 96 mol % water and 4 mol % EMIM-$BF_4$ solution and ultra-high purity Ar environment are provided. Only hydrogen ($H_2$) was identified as product.

The $CO_2$ reduction ability of bulk $MoS_2$ covered by flakes with exposed Mo-ended edges was first examined by performing a cyclic voltammetry (CV). The applied voltage was swept between +1.0 and −0.764 V vs. reversible hydrogen electrode (RHE; in the present study, all potentials are reported with respect to RHE) with a 15 mV/s scan rate. The experiments were conducted in a 2-compartment three-electrode electrochemical cell (FIG. 4) using argon (Ar) or $CO_2$ saturated 96 mol % water-4 mol % EMIM-$BF_4$ solution (pH~4) as an electrolyte. FIG. 5*a* represents the CV curve for the $CO_2$ reduction. It should be noted that the $CO_2$ reduction equilibrium potential is −0.11 V vs. RHE in the protic media. $CO_2$ reduction reaction initiated at −0.164 V confirmed by measuring CO as a product by gas chromatography (GC) system (CO Faradaic efficiency F.E.=~3%), suggesting a very low overpotential (54 mV) for CO formation in the system. At −0.2 V (90 mV overpotential) approximately 7% CO formation F.E. was measured (see FIG. 5*b*). $MoS_2$ also exhibits a significantly high $CO_2$ reduction current density (65 mA/$cm^2$ at −0.764 V), where $CO_2$ is selectively converted to CO (F.E.~98%). However, at the same potential (−0.764 V) the bulk Ag catalyst shows a considerably lower current density (3 mA/cm$^2$) (FIG. 5*a*) but for the $H_2$ formation (FIG. 6*a*). Ag NPs (average diameter of 40 nm) show only a current density of 10 mA/cm$^2$ with 65% selectivity for the CO formation under the same experimental conditions (FIGS. 5*a* and 6*b*). In addition, the $CO_2$ reduction current density for $MoS_2$ is also significantly higher than the maximum current density (~8.0 mA/cm$^2$) achieved when Ag NPs were used in the dynamic electrochemical flow cell using a similar electrolyte solution. For all the cases, the current densities were normalized against the geometrical surface area. Surprisingly, the $MoS_2$ catalyst also shows a high current density (50 mA/cm$^2$) in an Ar-saturated electrolyte, where only $H_2$ was detected as the major product (FIG. 7).

FIG. 5*b* shows the measured F.E. of the CO and $H_2$ formation for a wide range of applied potentials between −0.2 and −0.764 V. Depending on the applied potential, $MoS_2$ effectively operates as a catalyst for both $CO_2$ reduction and HER. $CO_2$ is converted at $MoS_2$ into a tunable mixture of $H_2$ and CO (syngas), ranging in each component from zero to ~100%. The variation in F.E. of CO and $H_2$ as a function of the applied potential originates from the differences in the $CO_2$ and HER reduction mechanisms. In theory, the favorable thermodynamic potential for the $H_2$ evolution is lower than $CO_2$ reduction. As the applied potential exceeds the onset potential of the $CO_2$ reduction (−0.164 V), this reaction is activated. Essentially, two $H^+$ are consumed for a CO formation as a result of one $CO_2$ molecule reduction. Thus, a fraction of both the existing $H^+$ (from the electrolyte) and the electrons (on the catalyst surface) are consumed in $CO_2$ reduction reactions instead of HER reactions. In addition, the EMIM-$CO_2$ complex works as an inhibitor for the $H_2$ formation in HER.

Figure 8:
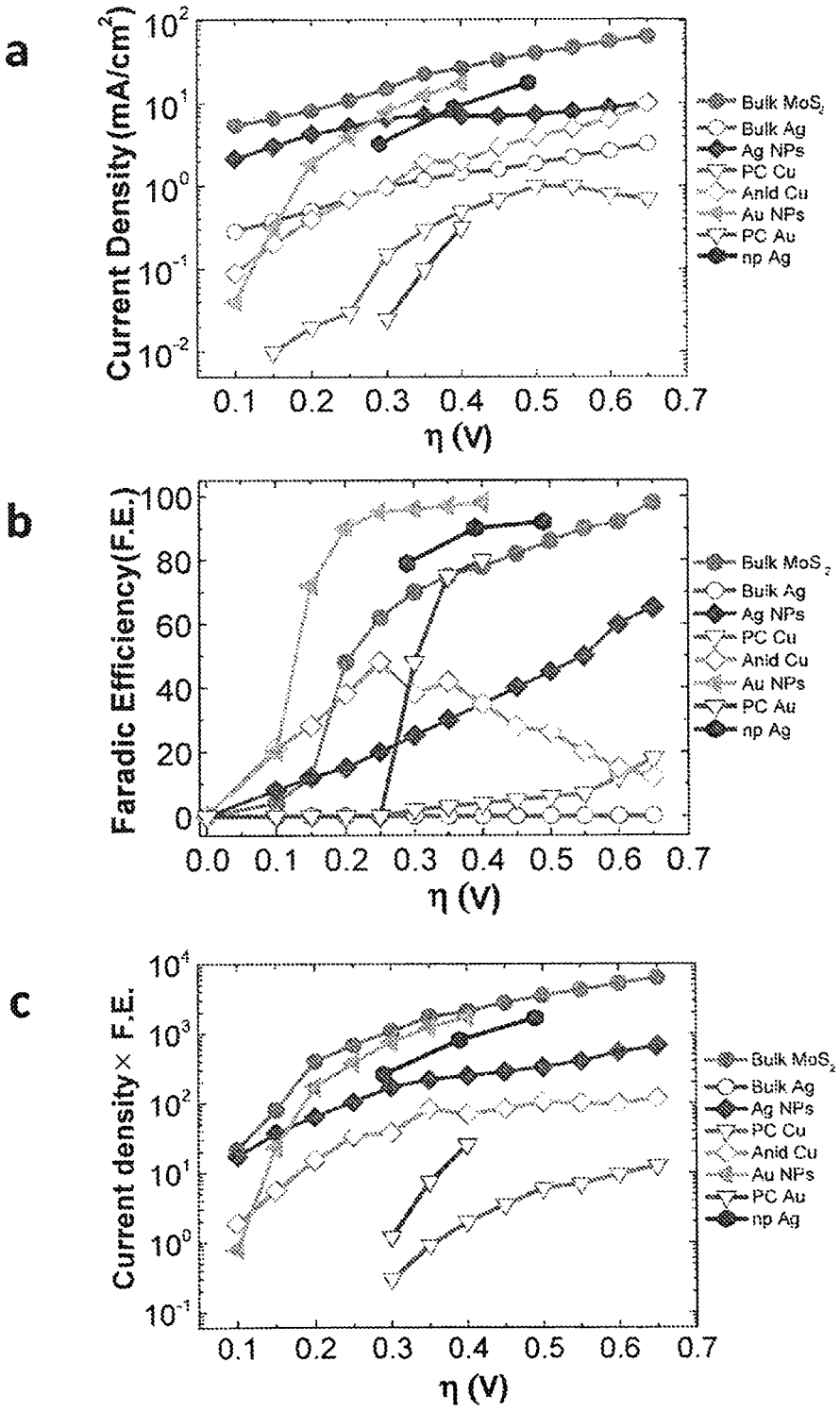
FIG. 8 shows the $CO_2$ reduction current densities and CO formation F.E. for different noble metal catalysts and bulk $MoS_2$. (a) $CO_2$ reduction current densities at different overpotentials (η). (b) CO formation Faradic Efficiency (F.E.) for different catalysts at different overpotentials. (c) Overview of different catalysts' performance at different overpotentials. Legends represent as follow: Bulk $MoS_2$—Bulk $MoS_2$, Bulk Ag—Ag film, Ag NPs—40 nm Ag nanoparticles, PC Cu—polycrystalline Cu, Annealed (Anid) Cu—thermally treated Cu, Au NPs—oxidized Au nanoparticles, PC Au—polycrystalline Au and nanoporous Ag—np Ag. For Au NPs, PC Au, PC Cu, AnId Cu, and np Ag data have been carefully extracted from the prior art.
Figure 9:
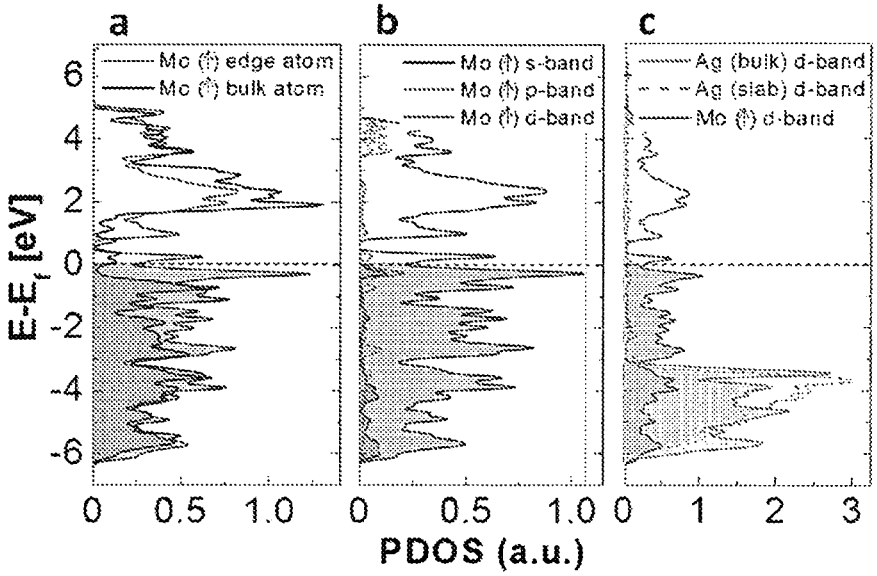
FIG. 9 shows DFT calculations of electron density. Projected density of states (PDOS) for spin up channel of: (a) the Mo atom at the edge and Mo atom within the lattice; (b) s, p, and d orbital of Mo-edge atom. (c) PDOS of d-band of Mo-edge atom, Ag atom from bulk and Ag-slab of 8.32 Å thickness. Electron density on Mo-edge atom is significantly (~11 times) higher than the electron density on Ag atom.

The $MoS_2$ catalyst performance was compared with the existing results for noble metal catalysts (FIG. 8). The current density represents the CO formation rate, whereas F.E. shows the amount of current density consumed to produce CO during the $CO_2$ reduction reaction. Thus, the catalysts' overall performance was compared by multiplying these two parameters at different overpotentials (FIG. 8*c*). Bulk $MoS_2$ exhibits the highest performance at all overpotentials. At low overpotentials (0.1 V), bulk $MoS_2$ shows almost 25 times higher $CO_2$ reduction performance compared to the Au NPs and about 1.3 times higher than the Ag NPs. At higher overpotentials (0.4 V), bulk $MoS_2$ exhibits approximately one order of magnitude higher performance than Ag NPs and more than two times higher than recently reported nanoporous Ag (np Ag). At this overpotential the Au NPs compete with bulk $MoS_2$. $MoS_2$ produces $H_2$ as a by-product which allows obtaining directly synthetic-gas while Au NPs produces formic acid ($HCOO^-$) as a by-product in the examined conditions. Bulk Ag is unable to reduce $CO_2$ in the examined experimental conditions. Moreover, the Cu performance remains below that of Ag NPs, Au NPs and bulk $MoS_2$. These results clearly indicate that $MoS_2$ exhibits the highest $CO_2$ reduction performance reported so far.

The catalytic activity of the $MoS_2$ catalyst for the $CO_2$ reduction was investigated with respect to the water mole fraction (FIG. 5*c*). The $CO_2$ reduction current density largely grows above 90 mol % water solution densities (inset FIG. 5*c*) and reaches a maximum in the 96 mol % water solution. The addition of water molecules can tailor the pH value (i.e. $H^+$ concentration) of the electrolyte (Table 2) and consequently affect the electrochemical reduction reaction rate. The pH of the electrolyte fluctuates due to the hydrolysis of $BF_4^-$, which produces anions [e.g. $(BF_3OH)^-$] and HF. The overall $CO_2$-to-CO conversion reaction requires both electrons and protons. The DFT calculations show significantly higher density (more than one order of magnitude) of d-electrons on Mo-edge atoms compared to Ag, suggesting that the concentration of protons ($H^+$) is the rate-determining part of the $CO_2$ reduction reaction. Thus, the attained maximum rate of the reduction process is attributed to: (i) the high concentration of $H^+$ (pH~4) in the reaction media and (ii) the low viscosity of the solution. The low viscosity allows for a high diffusion rate of the reactants (EMIM-$CO_2^-$ and $H^+$) towards the catalyst's active edge sites. A similar trend was observed for Ag NPs catalysts in a dynamic electrochemical flow cell when the maximum current density (~8 mA/cm$^2$) was obtained in a 90 mol % water electrolyte.

TABLE 2 pH value with respect to water mole fraction (measured by pH meter)

| Water mole fraction (mol % $H_2O$) | pH |
|---|---|
| 0 | 6.54 |
| 10 | 4.98 |
| 25 | 4.87 |
| 50 | 4.54 |
| 94 | 3.78 |
| 96 | 3.98 |
| 98 | 4.82 |
| 99 | 5.30 |
| 99.5 | 5.98 |

Additionally, a catalyst's stability is a major issue to be addressed. Thus, the stability of the catalyst for a prolonged period (10 hrs) was examined in 96 mol %, 90 mol % and 0 mol % water solutions. As seen in FIG. 5*d* the steady state current densities remain stable for the studied time (10 hrs), providing evidence of the long term stability and efficiency of the $MoS_2$ catalyst.

Figure 10:
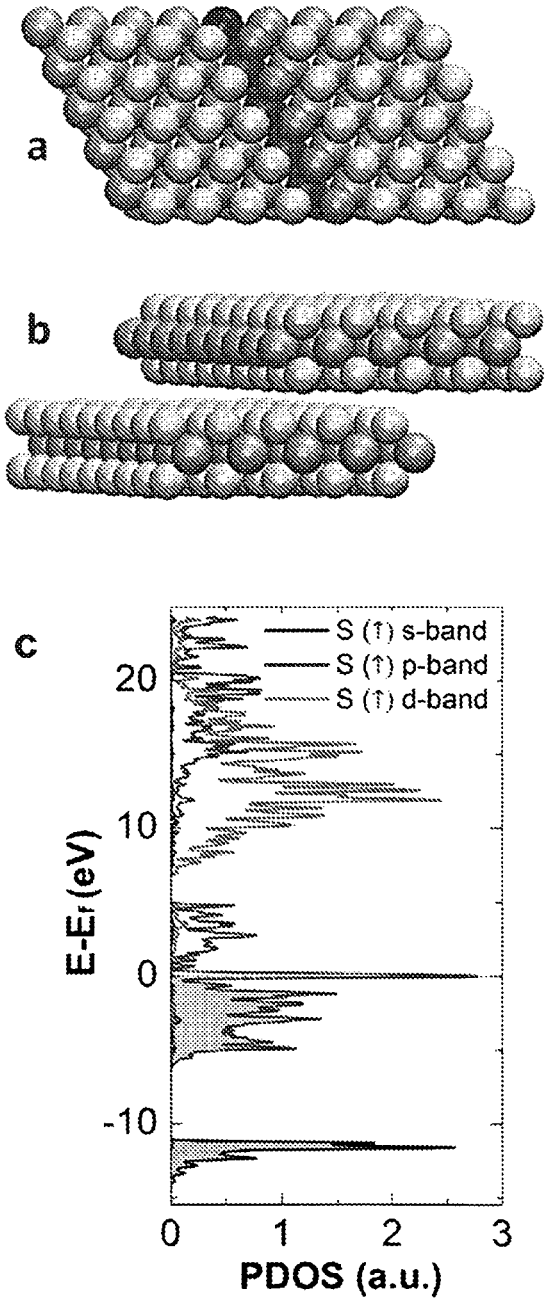
FIG. 10 shows DFT calculations performed on a single layer $MoS_2$ nanoribbon with zigzag edges. (a) A single layer nanoribbon. Mo-atoms are pink, S-atoms are yellow. In the unit cell bulk Mo-atoms are red, edge Mo-atom is blue, and S-atoms are orange. (b) Shifted double layer (side view). (c) Projected density of state (PDOS) for spin up channel of the edge sulfur (S) atoms in single $MoS_2$-nanoribbon: Contributions of s-, p-, and d-orbitals to DOS of the edge S atoms are shown.
Figure 11:
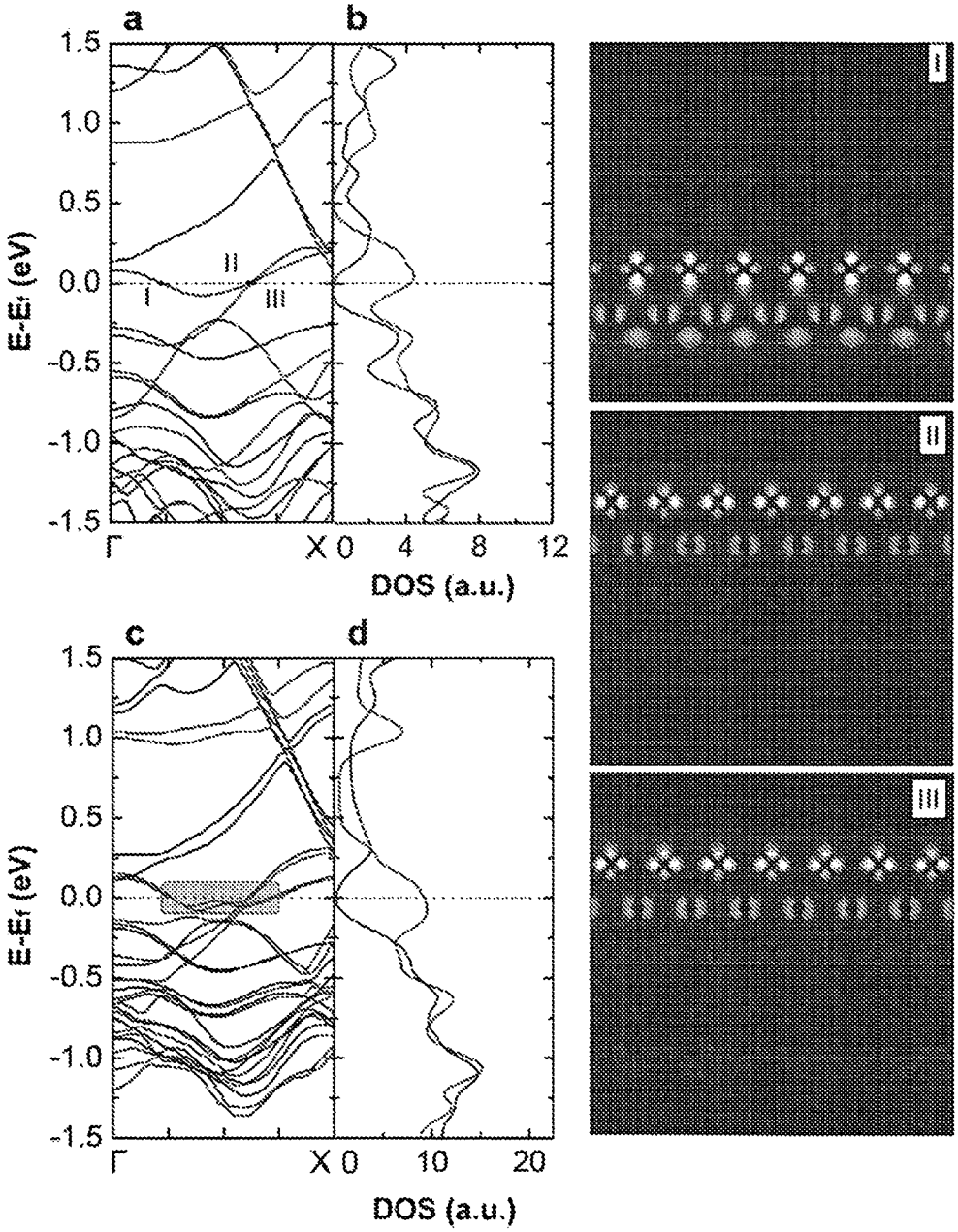
FIG. 11 shows the electronic structure of single and shifted double layer $MoS_2$-nanoribbon. (a) and (c) show band structures of $MoS_2$ single and double layer, respectively. (b) and (d) show the total DOS for corresponding structures. The red and blue lines denote the α- and β-spin channel bands, respectively. I, II, and III illustrate spatial profiles of modulus of wavefunctions for corresponding metallicity points (Mo-edge is at the top, S-edge is at the bottom).

In order to elucidate the origin of the high $CO_2$ reduction rate on the $MoS_2$ catalyst, the projected electron density (PDOS) per different Mo and S atoms was calculated using density functional theory (DFT) methods (for computational details see method section). The density of states (DOS) at the Fermi energy level ($E_f$) roughly determines the availability of electrons for a given reaction. The electronic structure of $MoS_2$ ribbons was found to be near $E_f$ formed by edge bands of only one spin polarization, originating from the Mo and S atoms exposed at both $MoS_2$ edges. In the vicinity of $E_f$, the spin-polarized PDOS for these Mo atoms is approximately twice larger than that of the bulk Mo atoms (FIG. 11*a*). Since the bulk Mo atoms, sandwiched between two S layers, are not directly exposed to the electrolyte, the $MoS_2$ catalytic activity should be primarily related to the edge states formed by Mo-edge atoms. The S atoms possess less reactive p-orbitals (FIG. 10), and they are not present at the catalytically active edge sites (confirmed by STEM).

Next, the PDOS of the Mo-edge atoms was resolved into s, p and d-orbital electron contributions (FIG. 11*b*). The obtained data indicate that near $E_f$ the PDOS is dominated by d-orbital (Mo) electron states, which are known to actively participate in catalyzed reactions. The Mo d-electrons form metallic edge states, which can freely supply electrons to the reactants attached at the edges. To assess how the Mo-edge states are affected by the presence of additional $MoS_2$ layers, the same analysis was performed for a double-layer $MoS_2$ strip. The calculations showed that an interlayer coupling further increases the d-electron PDOS near $E_f$ (FIG. 11*a-d*).

In the presence of an external bias all these d-electron states near $E_f$ can be accessed in the reaction, supporting the large observed $MoS_2$ activity. Finally, d-orbital PDOS in Mo-edge atoms was compared to that in Ag atoms in two structures: a bulk Ag and a two-dimensional slab Ag (both fcc lattice with a lattice constant of 4.09 Å) of a 8.32 Å thickness (after relaxation) (FIG. 11*c*). The d-band center for Mo edge atoms was found to be closer to the Fermi energy level than that in both Ag structures. This can partly explain the high catalytic activity of $MoS_2$, since the higher the d-band center is, the more reactive the metal is due to a lower transition state energy. Moreover, the PDOS of Mo-edge atoms near $E_f$ is approximately one order of magnitude higher than the PDOS of Ag atoms, suggesting the availability of the excess of d-electrons on the Mo-edge atoms. Without being bound to a particular theory it is believed that both these factors are mainly responsible for the high $CO_2$ reduction current density of $MoS_2$.

In order to reveal the role of EMIM ions in carrying $CO_2$ molecules, quantum molecular dynamics (QM/MM) simulations (TeraChem) of the $[EMIM\text{-}CO_2]^+$ complex hydrated in quantum water was also performed. The effect of different pH of the solution on the $[EMIM\text{-}CO_2]^+$ complex stability was tested in several possible configurations. The simulations reveal that $CO_2$ most likely binds to $EMIM^+$ through the C4/5 protons than through the C2 proton (known to provide stronger binding in vacuum). In this configuration the complex appears more stable (bond length) and it also provides a better protection against the conversion of $CO_2$ into $HCO_3^-$ and $CO_3^{2-}$=species.

Figure 12:
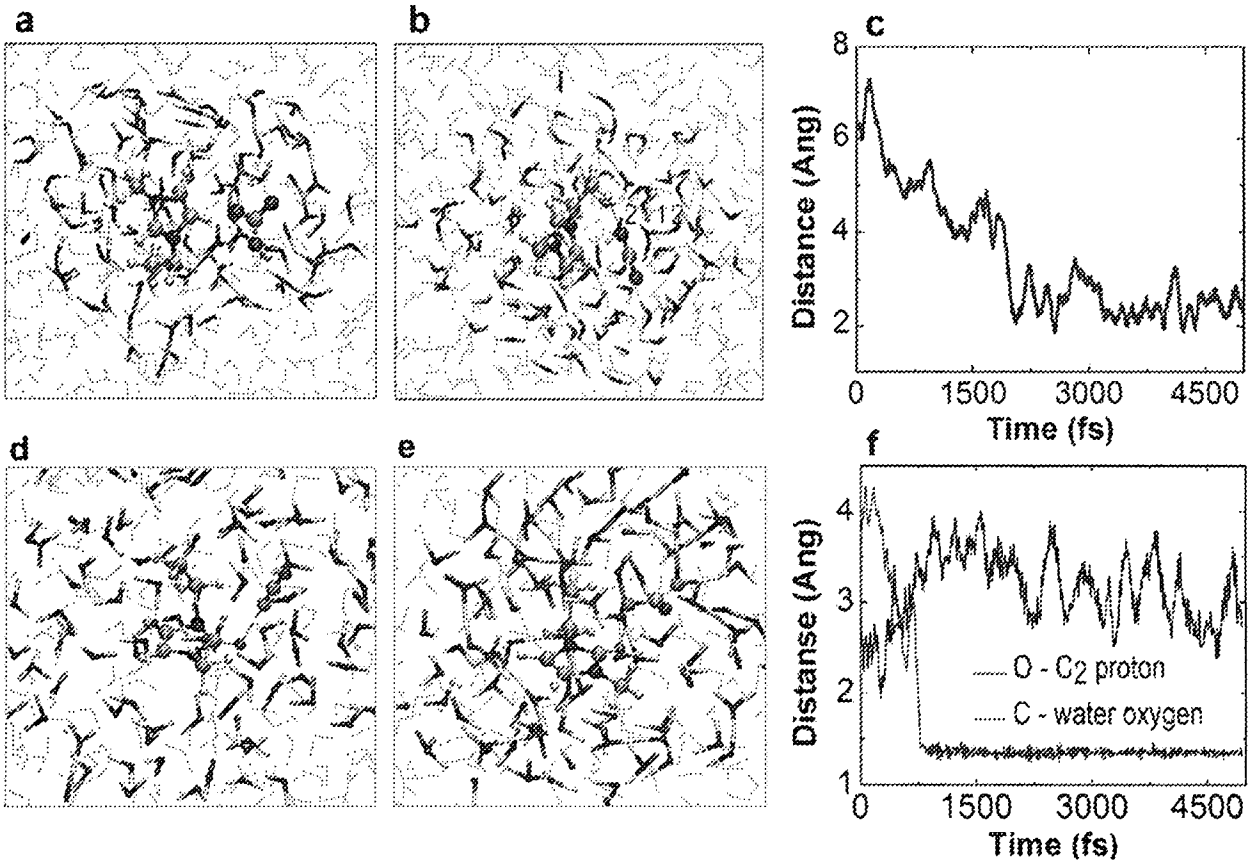
FIG. 12 shows formation and stability of $[EMIM\text{-}CO_2]^+$ complex. First row (complex near the $C_4$ proton): (a) Formation of the $[EMIM\text{-}HCO_3]$ complex in neutral conditions. (b) Formation of the $[EMIM\text{-}CO_2]$ complex in acidic conditions. (c) Time dependence of the hydrogen bond length formed between $CO_2$ and $EMIM^+$. Second row (complex near the $C_2$ proton in acidic pH): (d) Initial configuration $[EMIM\text{-}CO_2]$ complex with the H-bonds shown between the $C_2$ proton (highlighted by iceblue) and the oxygen (highlighted by orange) from $CO_2$. (e) Stabilization of the $[EMIM\text{-}CO_2]$ complex with an additional coordination of $CO_2$ and a water molecule (the oxygen is highlighted by orange). (f) Time dependence of the hydrogen bond length between $CO_2$ and $EMIM^+$ and between $CO_2$ and an adjacent water molecule.

The simulations revealed that the $EMIM^+$ cation forms a complex $[EMIM\text{-}CO_2]^+$ with $CO_2$ stabilized by hydrogen bonding (FIG. 12); however, the complex form depends on the pH of the electrolyte. In neutral solution, within ~2 ps, the $[EMIM\text{-}CO_2]^+$ complex reacts with water molecule, forming either the $[EMIM\text{-}HCO_3]$ or $[EMIM\text{-}CO_3]^-$ complexes (FIG. 12 *a*). It is well known that in neutral and basic conditions $HCO_3^-$ and $CO_3^{2-}$ are the dominant species, respectively. However, the QM/MM simulations reveal that in acidic environment, similar to the experimental conditions (pH<4), the $[EMIM\text{-}CO_2]^+$ complex remains stable (FIG. 12).

These results agree with the previous in-situ $EMIM\text{-}CO_2$ complex formation studies. The $[EMIM\text{-}CO_2]^+$ complexes may physisorb (Coulombic and van der Waals coupling) at the (negatively charged) $MoS_2$ cathode, resulting in a close encounter of the $CO_2$ molecules with the $MoS_2$ surface. The presence of $EMIM^+$ cations around $CO_2$ molecules may reduce the reaction barrier for electrons passing into $CO_2$. Thus, the observed high $CO_2$ reduction reaction is attributed to a synergistic action of the $MoS_2$ catalyst and the $EMIM\text{-}BF_4$ ionic liquid. While $EMIM\text{-}BF_4$ plays a crucial role by reducing the overpotential for the reaction, the $CO_2$ reduction rate is mainly governed by the intrinsic properties of the $MoS_2$ catalyst. In addition, the work function of $MoS_2$ was measured through the use of ultraviolet photoelectron spectroscopy. The obtained results indicate that the work function of $MoS_2$ (3.9 eV) is significantly lower than that of the bulk Ag (4.37 eV) and Ag NPs (4.38 eV). Due to the low work function of $MoS_2$, the abundant metallic-like d-electrons in its edge states can take part in the reactions, ultimately resulting in the superior $CO_2$ reduction performance compared to Ag.

Figure 13:
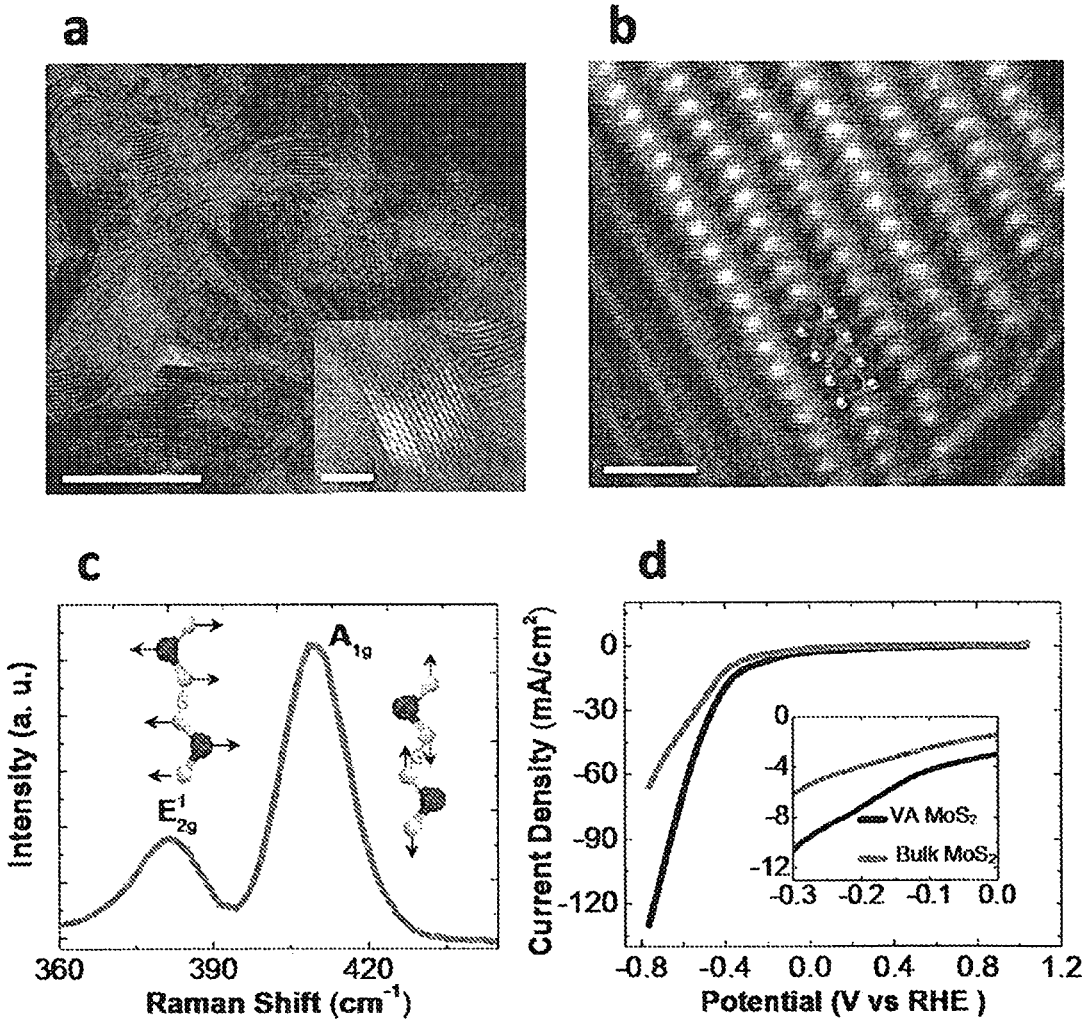
FIG. 13 shows vertically aligned $MoS_2$ nanoflakes. (a) Annular bright field (ABF) scanning transmission electron microscopy (STEM) images of vertically aligned $MoS_2$ (scale bar, 20 nm). STEM analysis (inset) shows the vertically aligned (VA) texture of $MoS_2$ nanoflakes (scale bar, 5 nm). (b) Red-green-blue (RGB) added image of (G+B) high-angle annular dark-field (HAADF) (R) inverted ABF STEM images of vertically aligned $MoS_2$. High resolution HAADF STEM image of vertically aligned $MoS_2$ (scale bar, 2 nm). Mo atoms are brighter and larger in size in comparison to sulfur atoms due to high atomic number. (c) Raman spectrum for vertically aligned $MoS_2$. (d) $CO_2$ reduction performance of bulk $MoS_2$ and vertically aligned $MoS_2$ represented by VA $MoS_2$.

A vertically aligned $MoS_2$ nanosheet was synthesized, and observed another factor of two improvements on the $CO_2$ reduction performance. In brief, a 5 nm thick layer of molybdenum was deposited on glassy carbon substrate by electron beam evaporation, followed by sulfurization by exposing the film to a sulfur vapor stream at 700° C. FIG. 13*a* presents a HAADF and annular bright field (ABF) image of the vertically aligned $MoS_2$ nanosheets. While the $MoS_2$ layers are generally aligned perpendicular to the substrate surface, only a few select sheets can be found which are aligned parallel to the electron beam to allow for atomic resolution imaging (FIG. 13*b*). This image identifies the clearly-separated Mo and S atomic columns, as the Mo atoms are heavier and thus appear brighter. The proposed atomic structure of the Mo and S layers is superimposed on the atomic-resolution image in FIG. 13*b*. While the nature of the terminating atoms in these $MoS_2$ nanosheets cannot be directly visualized in this orientation, previous results have shown that synthesized $MoS_2$ nanosheets are generally terminated by Mo atoms due to their low-energy state. The vertically aligned $MoS_2$ samples were further characterized by Raman spectroscopy (FIG. 13*c*). Two essential peaks are clearly visible at 385 (in-plane Mo—S phonon mode-$E^1_{2g}$ mode) and 408 $cm^{-1}$ (out-of plane Mo—S phonon mode-$A^1_g$ mode) respectively. The ratio of out-of plain $A^1_g$ phonon mode to $E^1_{2g}$ mode is significantly high (~3), which clearly supports the existence of vertically orientated nature of $MoS_2$ flakes.

FIG. 13*d* shows the $CO_2$ reduction performance of the vertically aligned $MoS_2$ obtained in similar experimental conditions (i.e., 96 mol % water and 4 mol % $EMIM\text{-}BF_4$). As expected, $CO_2$ reduction reaction initiated at low overpotential (54 mV) similar to bulk $MoS_2$. Additionally, further improvement has been observed within complete applied potential range (FIG. 13*d*). In the low applied potential region, vertically aligned $MoS_2$ exhibits two times higher $CO_2$ reduction current density compared to the bulk $MoS_2$ as shown in inset of FIG. 13*d*. This trend remains also valid in the high potential region. At −0.764 V a remarkably high $CO_2$ reduction current density (130 $mA/cm^2$) was recorded for vertically aligned $MoS_2$. The high catalytic performance of vertically aligned $MoS_2$ is attributed to the high density of active sites preferably Mo atoms available for the $CO_2$ reduction reaction.

Example 9: Microfluidic Reactor Studies

The electrochemical activity of the TMDC (e.g., $MoS_2$) and the helper catalyst ionic liquid (e.g., $EMIM\text{-}BF_4$) system was also studied in a microfluidic reactor. This technology has numerous advantages over standard electrochemical cell as $CO_2$ can be continuously converted to a desired product (e.g., syngas).

Figure 16:
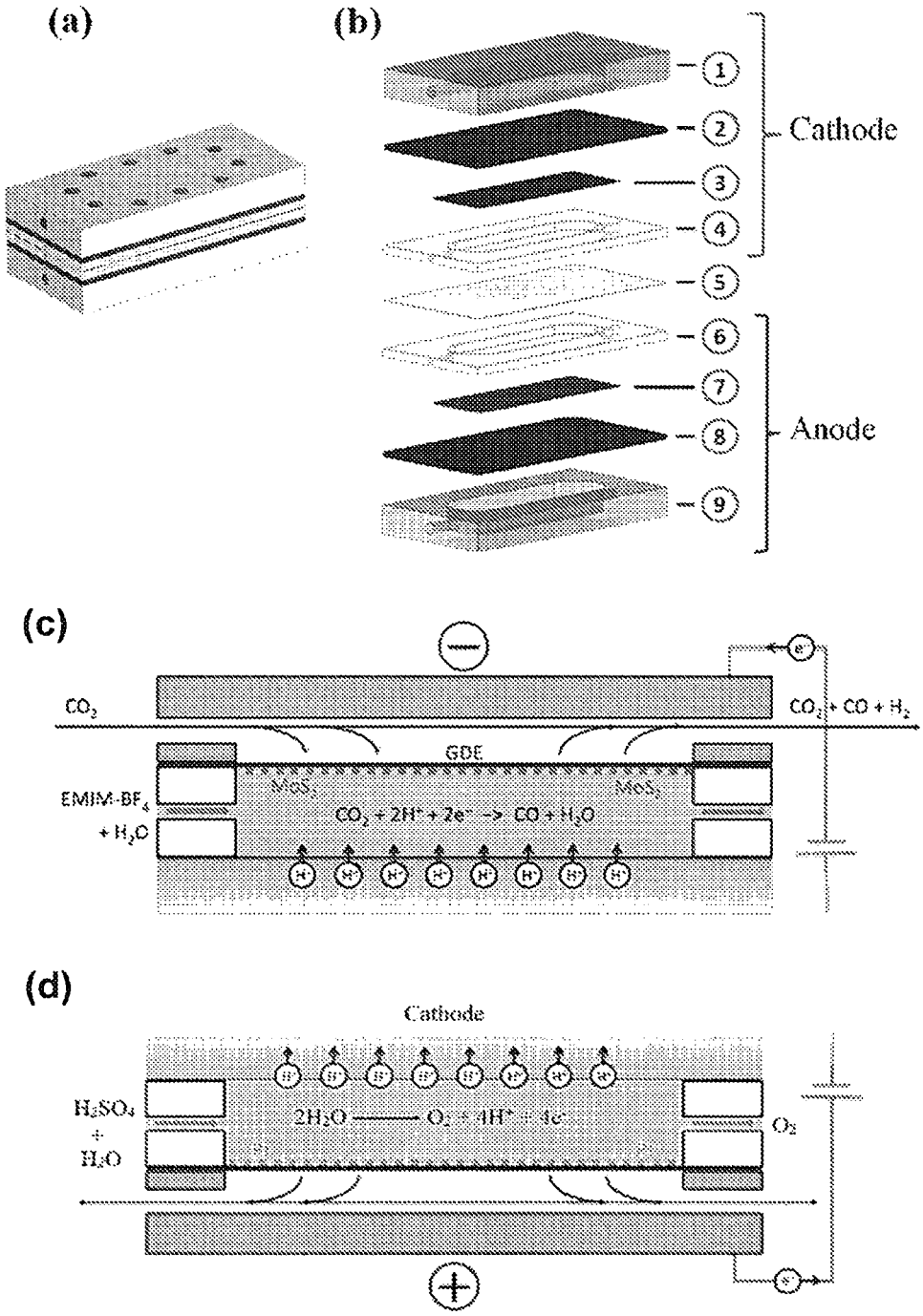
FIG. 16 illustrates microfluidic reactor design. Schematic of flow-cell reactor (a) integrated view, and (b) exploded view of the microfluidic reactor for electrochemical $CO_2$ reduction (labels: (1) cathode current collector/gas channel for $CO_2$; (2) GDE cathode; (3) $MoS_2$ catalyst; (4) Teflon® liquid channel for catholyte; (5) membrane; (6) Teflon® liquid channel for anolyte; (7) Pt catalyst; (8) GDE anode; (9) anode current collector/gas channel for $O_2$). (c) Schematic of the reactions occurring at the cathode of the microfluidic reactor. (Dimensions are exaggerated for clarity). (d) Schematic of the reactions occurring at the anode of the microfluidic reactor. (Dimensions are exaggerated for clarity).

Microfluidic Reactor Design:

FIG. 16*a-b* shows the schematic diagram of the integrated and exploded microfluidic reactor. Microfluidic reactor can be divided in two separate compartments i.e., anode and cathode compartment. These compartments are separated by a proton exchange membrane which separates the catholyte from the anolyte maintaining electrical conductivity. Anode compartment consists: (i) Teflon® liquid channel for anolyte and, (ii) anode current collector/gas channel for $O_2$. Similarly, cathode current collector/gas channel for $CO_2$ and Teflon® liquid channel for catholyte are the main components of the cathode part.

Gas diffusion electrodes (GDEs) are used as a substrate to deposit the cathode and anode material. The catalyst ($MoS_2$ nanoparticles for the cathode and Pt black for the anode) is applied on the side of the GDEs that face their respective liquid. The $CO_2$ flows from a gas channel that also operates as the cathode current collector. $CO_2$ then diffuses through the GDE, mixing with the catholyte (different mole fraction of EMIM-$BF_4$) and reacts at the catalyst surface producing CO. Schematics of the half-reactions that occur at the electrodes are shown on FIG. 16*c* and FIG. 16*d*.

Figure 17:
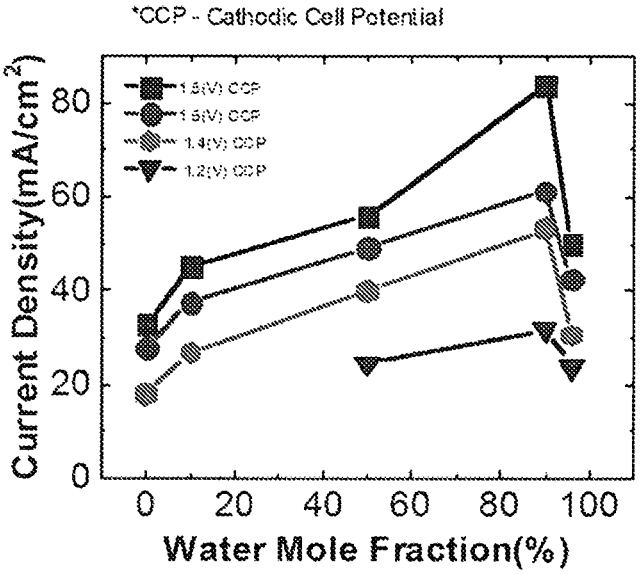
FIG. 17 shows variation of flow-cell reactor current density versus water mole fraction at different cathode potentials (1.8, 1.6, 1.4, and 1.2 V vs Ag wire) for the TMDC and ionic liquid system (e.g., $MoS_2$/EMIM-$BF_4$).
Figure 18:
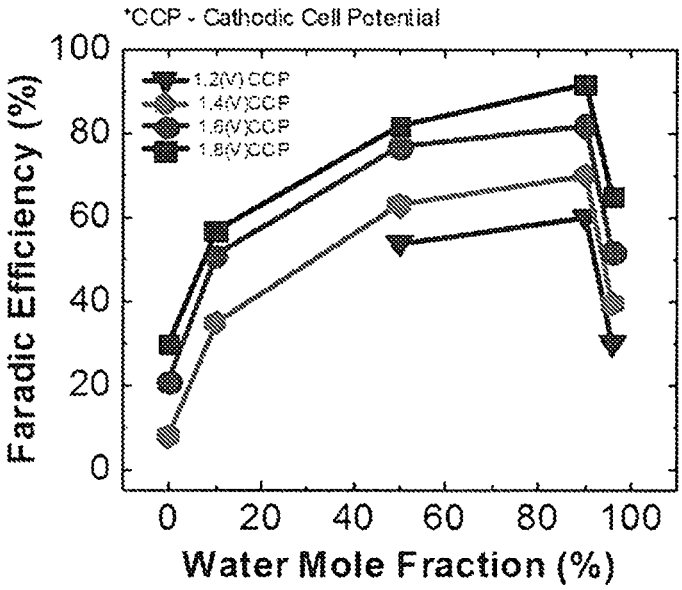
FIG. 18 shows variation of $CO_2$ reduction F.E. versus water mole fraction inside the flow-cell reactor at different cathode potentials (1.8, 1.6, 1.4, and 1.2 V vs Ag wire) for the TMDC and ionic liquid system (e.g., $MoS_2$/EMIM-$BF_4$).

Results:

The performance of assembled microfluidic reactor for the TMDC/helper catalyst system was tested at different ionic liquid mole fractions and cathode potentials ranging between −1.8 to −1.2V vs Ag wire. For each potential, different water mole fractions i. e., 4, 10, 50, 90 and 100 mol % were tested in continues flow cell and obtained product F.E. and reaction current densities were plotted (FIGS. 17 and 18). Alike batch process, a similar trend has been observed in different water mole fraction. The maximum current density (88 mA/$cm^2$) was recorded at −1.8 v vs Ag wire in 90 mol % water and 10 mol % EMIM-$BF_4$. At similar experimental condition, 92% CO formation F.E. was obtained. Moreover this result also confirm that variation of potential windows and water mole fraction provides a good autonomy to produce different concentration of syn-gas (mixture of CO and $H_2$), which is necessary for industrial application with different concentration of syn-gas as a feedstock base on their process limitation.

It is understood that the examples and embodiments described herein are for illustrative purposes only and that various modifications or changes in light thereof will be suggested to persons skilled in the art and are to be incorporated within the spirit and purview of this application and scope of the appended claims. All publications, patents, and patent applications cited herein are hereby incorporated herein by reference for all purposes.

We claim:

1. A method of electrochemically reducing carbon dioxide in an electrochemical cell having a cathode comprising at least one transition metal dichalcogenide, an electrolyte in contact with the cathode, and an anode, the method comprising contacting the carbon dioxide with the at least one transition metal dichalcogenide of the cathode of the electrochemical cell, the electrolyte comprising at least one helper catalyst, each helper catalyst comprising at least one positively charged nitrogen, sulfur, or phosphorus group and applying a potential to the electrochemical cell sufficient to reduce the carbon dioxide, wherein the transition metal dichalcogenide is in nanoflake, nanosheet, or nanoribbon form, the transition metal dichalcogenide nanoflakes, nanosheets, or nanoribbons having an average size between about 1 nm and 400 nm.

2. A method of claim 1, wherein the transition metal dichalcogenide is selected from the group consisting of $TiX_2$, $VX_2$, $CrX_2$, $ZrX_2$, $NbX_2$, $MoX_2$, $HfX_2$, $WX_2$, $TaX_2$, $TcX_2$, and $ReX_2$, wherein X is independently S, Se, or Te.

3. A method of claim 1, wherein the transition metal dichalcogenide is $MoS_2$ or $MoSe_2$.

4. A method of claim 1, wherein the transition metal dichalcogenide is in nanoflake form.

5. A method of claim 4, wherein the transition metal dichalcogenide nanoflakes, nanosheets, or nanoribbons have an average size between about 50 nm and 400 nm.

6. A method of claim 1, wherein the helper catalyst is an imidazolium, pyridinium, pyrrolidinium, phosphonium, ammonium, choline, sulfonium, prolinate, or methioninate salt.

7. A method of claim 1, wherein the helper catalyst is an imidazolium salt, the imidazolium of the imidazolium salt having the formula:

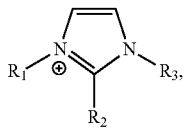

wherein $R_1$, $R_2$, and $R_3$ are independently selected from the group consisting of hydrogen, linear aliphatic $C_1$-$C_6$ group, branched aliphatic $C_1$-$C_6$ group and cyclic aliphatic $C_1$-$C_6$ group.

8. A method of claim 1, wherein the helper catalyst is ethyl-3-methylimidazolium tetrafluoroborate.

9. A method of claim 1, wherein the electrolyte is an aqueous solution.

10. A method of claim 9, wherein the helper catalyst is present in the aqueous solution within the range from about 2 mol % to about 10 mol %.

11. A method of claim 1, wherein the carbon dioxide is reduced to CO with a Faradaic efficiency of at least about 90%.

12. A method of claim 1, wherein the applied potential is about −2 to about +2 V vs. reversible hydrogen electrode.

13. A method of claim 1, wherein the reduction of carbon dioxide is initiated at overpotential of less than about 100 mV.

14. A method of claim 1, wherein the reduction of carbon dioxide is at least about 90% Faradaic efficiency.

15. A method of claim 1, wherein the transition metal dichalcogenide is vertically aligned.

16. A method of claim 1, wherein the reduction of carbon dioxide is initiated at overpotential of less than about 100 mV and the carbon dioxide is reduced to CO with a Faradaic efficiency of at least about 90%.

17. A method of claim 1, wherein the reduction of carbon dioxide is initiated at overpotential of less than about 100 mV and the reduction of carbon dioxide is at least about 90% Faradaic efficiency.

18. An electrochemical cell having a cathode comprising at least one transition metal dichalcogenide, wherein the transition metal dichalcogenide is in nanoflake, nanosheet, or nanoribbon form, the transition metal dichalcogenide nanoflakes, nanosheets, or nanoribbons having an average size between about 1 nm and 400 nm, and an electrolyte comprising at least one helper catalyst comprising at least one positively charged nitrogen, sulfur, or phosphorus group in contact with the transition metal dichalcogenide.

19. An electrochemical cell according to claim 18, wherein the transition metal dichalcogenide is $MoS_2$.

20. An electrochemical cell according to claim 18, wherein the helper catalyst is present in an amount of about 4 mol % to about 10 mol %.

21. An electrochemical cell according to claim 18, wherein the helper catalyst is ethyl-3-methylimidazolium salt tetrafluoroborate.

22. An electrochemical cell of claim 18, wherein the helper catalyst is an imidazolium, pyridinium, pyrrolidinium, phosphonium, ammonium, choline, sulfonium, prolinate, or methioninate salt.

* * * * *